US006447101B1

(12) United States Patent
Adachi et al.

(10) Patent No.: US 6,447,101 B1
(45) Date of Patent: Sep. 10, 2002

(54) IMAGE FORMING DEVICE

(75) Inventors: Katsumi Adachi, Nara; Daisaku Imaizumi, Yamatokoriyama; Takasumi Wada, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/307,654

(22) Filed: May 7, 1999

(30) Foreign Application Priority Data

May 7, 1998 (JP) ..... 10-125003

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 158; 399/271, 290, 292, 293, 294, 295

(56) References Cited

U.S. PATENT DOCUMENTS 5,508,723 A 4/1996 Maeda
6,102,526 A * 8/2000 Tunius ..... 347/55
6,109,730 A * 8/2000 Nilsson et al. ..... 347/55

FOREIGN PATENT DOCUMENTS

JP 5-208520 8/1993
JP 10/250137 9/1998
JP 10-258539 9/1998
WO WO 89/05231 6/1989

* cited by examiner

*Primary Examiner*—Raquel Yvette Gordon
(74) *Attorney, Agent, or Firm*—Dike Bronstein, Roberts & Cushman IP Group Edwards & Angell, LLP; David G. Conlin; David A. Tucker

(57) ABSTRACT

The present image forming device is provided with a toner carrier and a counter electrode opposite the toner carrier. Between the toner carrier and the counter electrode is provided a jet control section having a plurality of gates, each forming a space for passage of a jet of toner. Also provided is a control electrode driver, which is capable of applying potentials independently to each gate of the jet control section. The present image forming device forms a toner image on a transfer material by controlling passage of toner through a given gate by application of an ON potential which allows passage of the toner through the gate and an OFF potential which prevents passage of the toner through the gate. A potential difference VH between the toner carrier and the counter electrode and an intensity EH of an electrical field in the vicinity of the counter electrode satisfy VH≦1.5 kV and EH≧1.8 kV/mm, respectively. Thus it is possible to provide a toner jet image forming device which reduces scattering occurring when the toner particles strike the transfer material, and which is able to form good pixels and good images.

12 Claims, 19 Drawing Sheets

IMAGE FORMING DEVICE

FIELD OF THE INVENTION

The present invention relates to an image forming device which forms an image on a recording medium by means of a toner jet, for use in a printing section of a digital copying device or facsimile device, or in a digital printer, plotter, etc.

BACKGROUND OF THE INVENTION

Conventionally, many image forming devices have used the so-called electrophotographic process, in which image information is converted into light, which is projected onto a photosensitive body to form an electrostatic latent image thereon, which is then developed with toner. However, in recent years, in accompaniment with the rapid progress of digitalization due to the dissemination of computers, etc. and improvement in their performance, image forming devices of the jet type, which form an image directly using a jet of ink or toner, have been proposed, with the object of forming high-quality images using a simpler structure.

Various methods have been proposed for toner jet image forming devices, which form an image directly using a jet of toner, because they are capable of realizing high-quality, visually excellent printing using toner equivalent to that used in the electrophotographic process, and because they do not require an optical writing system, photosensitive body, etc.

For example, Japanese Examined Patent Publication No. 1-503221/1989 (Tokuhyohei 1-503221, published on Nov. 2, 1989) discloses a method of applying a voltage to wires provided in matrix form to form a charge image in the vicinity of the wires, and then allowing toner to act on the charge image to form a toner image.

Since printing is performed solely by a toner jet effect from a toner carrier to a transfer material, this kind of toner jet image forming device calls for stable control of the jet of toner particles and prevention of scattering of the toner particles after striking the transfer material.

For example, Japanese Unexamined Patent Publication No. 5-208520/1993 (Tokukaihei 5-208520, published on Aug. 20, 1993) discloses a method which attempts to prevent scattering of the toner particles when striking the transfer material after jet control, by using a capsule toner which, upon striking the transfer material, releases an adhesive member, causing the toner to adhere to the transfer material, and preventing secondary scattering of the toner.

Further, Japanese Patent Application No. 9-61488/1997 (Tokuganhei 9-61488), corresponding to Japanese Unexamined Patent Publication No. 10-250137/1998 (Tokukaihei 10-250137, published on Sep. 22, 1998), discloses a method which attempts to reduce the speed of the jet, in order to weaken the shock of collision of the toner particles with the transfer material, by applying a braking potential to reduce scattering.

Further, Japanese Patent Application No. 9-67000/1997 (Tokuganhei 9-67000), corresponding to Japanese Unexamined Patent Publication No. 10-258539/1998 (Tokukaihei 10-258539, published on Sep. 29, 1998), discloses a method which provides separation distance reducing means, which cause a magnetic field to act on charged developer particles (toner particles) which separate immediately before or after striking a recording medium, thus reducing the distance of separation thereof.

However, a problem with conventional toner jet image forming devices is that they are prone to so-called scattering, in which the high speed of collision of the toner with the transfer material causes the toner particles to rebound on impact, and scatter in the vicinity of the impact position, thus greatly impairing image quality.

In this connection, the method disclosed in Japanese Unexamined Patent Publication No. 5-208520 above prevents scattering of toner by means of a capsule toner which releases an adhesive member upon striking the transfer material, whereby the shock of collision when the toner particles strike the transfer material breaks the capsules to release the adhesive member contained therein. However, this method greatly restricts the materials which can be used for the toner, and it is difficult to obtain desired charging characteristics.

Further, in charging the toner, forces to which the toner particles are subjected must be constrained to an extent at which the toner particles will not break, thus restricting the charging methods which can be used to methods which do not involve excessive friction or pressure.

The method proposed in Japanese Patent Application No. 9-61488, on the other hand, uses conventional toner, and reduces the force of collision of the toner when striking the transfer material by forming an electrical field which reduces the speed of the toner jet. However, since the electrical field toward the transfer material is weak at the impact surface, rebound of and repulsive force among toner particles causes them to spread out horizontally.

Further, in the method of Japanese Patent Application No. 9-67000, in order to reduce scattering of the toner particles immediately before and after striking the recording medium, a magnetic field acts on the charged toner particles to create a force which causes the toner particles to converge. Thus a very strong magnetic field is necessary, and the size of the device is increased.

In light of the foregoing shortcomings with conventional toner jet image forming devices, there is a need for a method of reducing toner scattering by means of a simple structure.

SUMMARY OF THE INVENTION

It is an object of the present invention to provide a toner jet image forming device which is able to form good pixels and good images by reducing scattering which occurs when toner particles strike a transfer material.

In order to attain the foregoing object, an image forming device according to the present invention comprises: a toner carrier, which carries toner charged with a predetermined polarity; a counter electrode, provided opposite the toner carrier, to which a voltage can be applied; a control section, provided between the toner carrier and the counter electrode, having a plurality of gates, each forming a space for passage of a jet of toner from the toner carrier toward the counter electrode; and voltage applying means, capable of applying potentials independently to each of the gates of the control section; the image forming device controlling passage of toner through a given gate by application of a first potential which allows passage of the toner through that gate and a second potential which prevents passage of the toner through that gate, and forming a toner image on a transfer material, which is in contact with the counter electrode and which moves relative to the control section; in which a potential difference VH between the toner carrier and the counter electrode and an intensity EH of an electrical field in the vicinity of the counter electrode satisfy $VH \leqq 1.5$ kV and $EH \geqq 1.8$ kV/mm, respectively.

With the foregoing structure, by optimizing the potential difference between the toner carrier and the counter electrode and the electrical field intensity in the vicinity of the counter electrode (i.e., the electrical field intensity on the surface of the transfer material), good toner images with little toner scattering can be formed.

In other words, as shown in FIGS. 19(*a*) and 19(*b*), toner particles T leave the toner carrier, pass through the gates of the control section, and jet toward the counter electrode 11.

At this time, if the speed of the jet is high, repulsive force when the toner particles T strike the transfer material P is increased, and the toner particles T rebound greatly, as shown in FIG. 19(*a*), thus increasing scattering to areas surrounding the pixel.

If, on the other hand, electrical field intensity in the vicinity of the transfer material P is weak, the influence of repulsive force among the toner particles T, charging of the transfer material P, etc. causes the toner particles T to spread out over the surface of the transfer material P immediately before and after impact, as shown in FIG. 19(*b*).

Increasing the electrical field intensity and the distance the jet travels increases the speed of the toner jet, and thus increases rebound of the toner particles. However, decreasing the intensity of the jet electrical field increases the mutual repulsive force among the toner particles while in the jet and upon striking the transfer material, and also decreases the force with which they are attracted toward the counter electrode 11, thus causing spreading of the toner image. In the present invention, "jet electrical field" means an electrical field which causes the toner T to jet from the toner carrier toward the counter electrode 11 and strike the transfer material P, and is an electrical field intensity in the vicinity of the counter electrode 11 and the transfer material P (EH, E1).

As a result of assiduous investigations conducted to resolve the foregoing problems, the present inventors found that a converged toner image with little scattering can be formed if a potential difference VH between the toner carrier and the counter electrode 11 and an intensity EH of an electrical field in the vicinity of the counter electrode 11, which influence the speed of the toner jet when striking the transfer material, are set to VH≦1.5 kV and EH≧1.8 kV/mm, respectively.

Incidentally, if the control section is made up of a single layer of control electrodes only, the potential difference between the control electrodes and the counter electrode 11 and the electric field intensity in the vicinity of the counter electrode 11 vary according to the ON potential (first potential) and OFF potential (second potential) of the control electrodes, but if the foregoing conditions are satisfied, a converged toner image free of scattering can be obtained.

Further, in order to attain the foregoing object, an image forming device according to the present invention comprises: a toner carrier, which carries toner charged with a predetermined polarity; a counter electrode, provided opposite the toner carrier, to which a voltage can be applied; a control section, provided between the toner carrier and the counter electrode, having a plurality of gates, each forming a space for passage of a jet of toner from the toner carrier toward the counter electrode; and voltage applying means, capable of applying potentials independently to each gate of the control section; the image forming device controlling passage of toner through a given gate by application of a first potential which allows passage of the toner through that gate and a second potential which prevents passage of the toner through that gate, and forming a toner image on a transfer material, which is in contact with the counter electrode and which moves relative to the control section; in which the image forming device further comprises, between the control section and the counter electrode, a first electrode layer extending two-dimensionally opposite the counter electrode, provided with holes, corresponding to the gates of the control section, for passage of toner; and a potential difference VH between the toner carrier and the counter electrode, a potential difference V1 between the first electrode layer and the counter electrode, a distance d1 between the first electrode layer and the counter electrode, and an intensity E1 (=V1/d1) of an electrical field in the vicinity of the counter electrode satisfy VH≦1.5 kV and E1≧1.8 kV/mm, respectively.

In other words, the present inventors found that by providing the first electrode layer, through which toner can pass and to which a voltage can be applied, between the control section and the counter electrode, and by setting a potential difference VH between the toner carrier and the counter electrode, a potential difference V1 between the first electrode layer and the counter electrode, a distance d1 between the first electrode layer and the counter electrode, and an electrical field intensity E1 in the vicinity of the counter electrode (=V1/d1) (which are factors which influence toner jet speed when striking the transfer material) so as to satisfy VH≦1.5 kV and E1≧1.8 kV/mm, regardless of the distance of the control section from the counter electrode, the electrical field intensity E1 could be optimized, and a converged toner image with little scattering could be formed.

For example, since the distance between the toner carrier and the control section is typically maintained at around 100 μm, for example, the control section is usually integrally provided with a toner supply section, which includes the toner carrier. In such a case, rotation of the toner carrier may cause vibration of the control section in the direction of the toner jet. However, in the present invention, since the conditions of control of the toner when it strikes the transfer material are determined by the voltage applied to the first electrode layer and the distance between the first electrode layer and the counter electrode, a converged toner image with little scattering can be formed even if such vibration occurs.

Incidentally, instead of providing the first electrode layer separately from the control section, it may be provided integrally therewith.

Further, the first electrode layer may be provided so as to come into contact with the transfer material at a position upstream, with respect to the direction of movement of the transfer material, from a position at which the toner strikes the transfer material, so that the first electrode layer is a fixed distance from the counter electrode and the transfer material. In this way, it is possible to maintain a constant interval between the first electrode layer and the transfer material.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 19(*b*) showing the situation of a weak electrical field intensity in the vicinity of the transfer material P, in which the influence of repulsive force among toner particles, charging of the transfer material P, etc. causes the toner particles to spread out over the surface of the transfer material P immediately before and after impact.

DETAILED DESCRIPTION OF THE PREFERRED EMBODIMENTS

The following will explain an embodiment of the present invention with reference to FIGS. 1 through 18.

Figure 2:
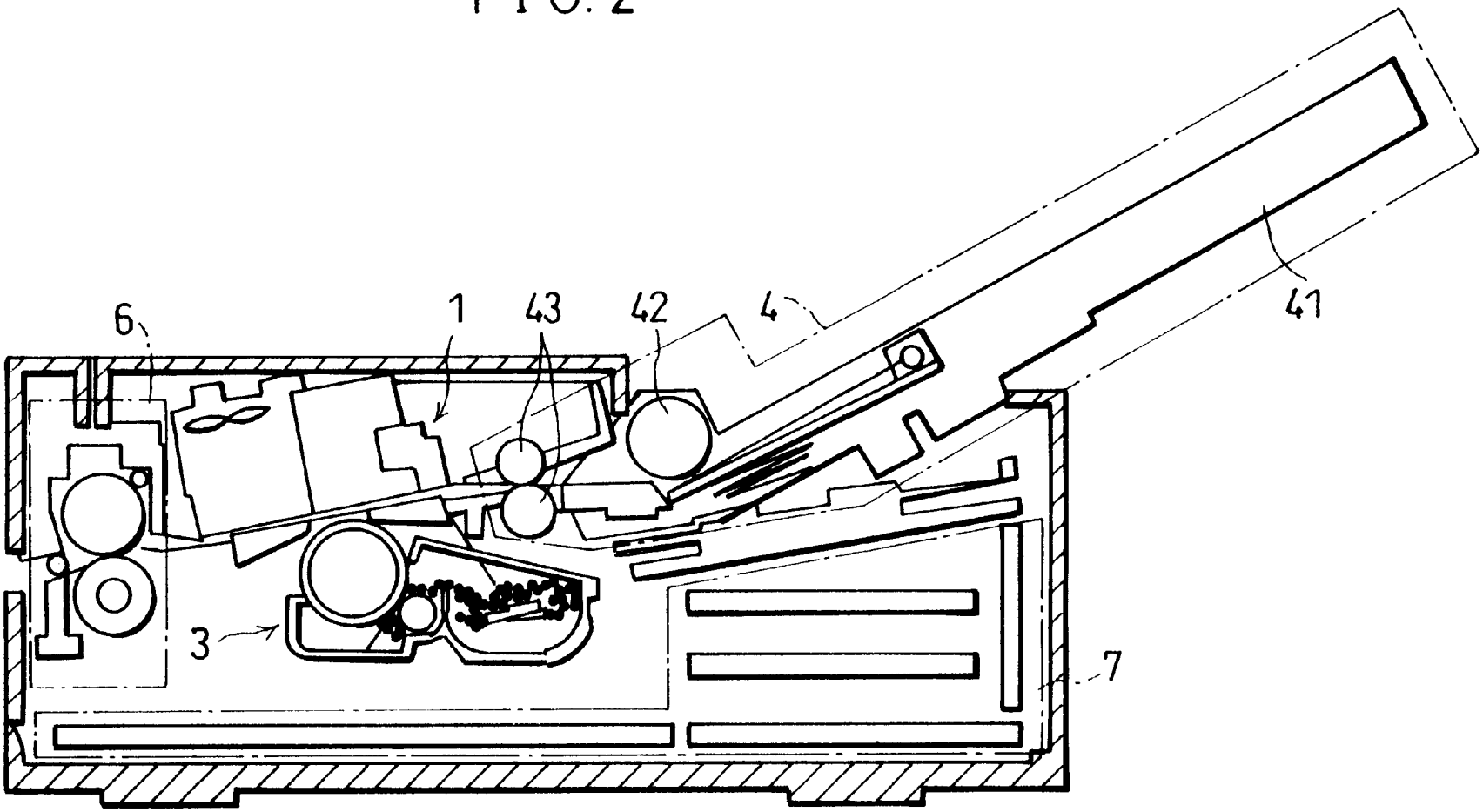
FIG. 2 is a drawing schematically showing the overall structure of the foregoing image forming device.
Figure 18:
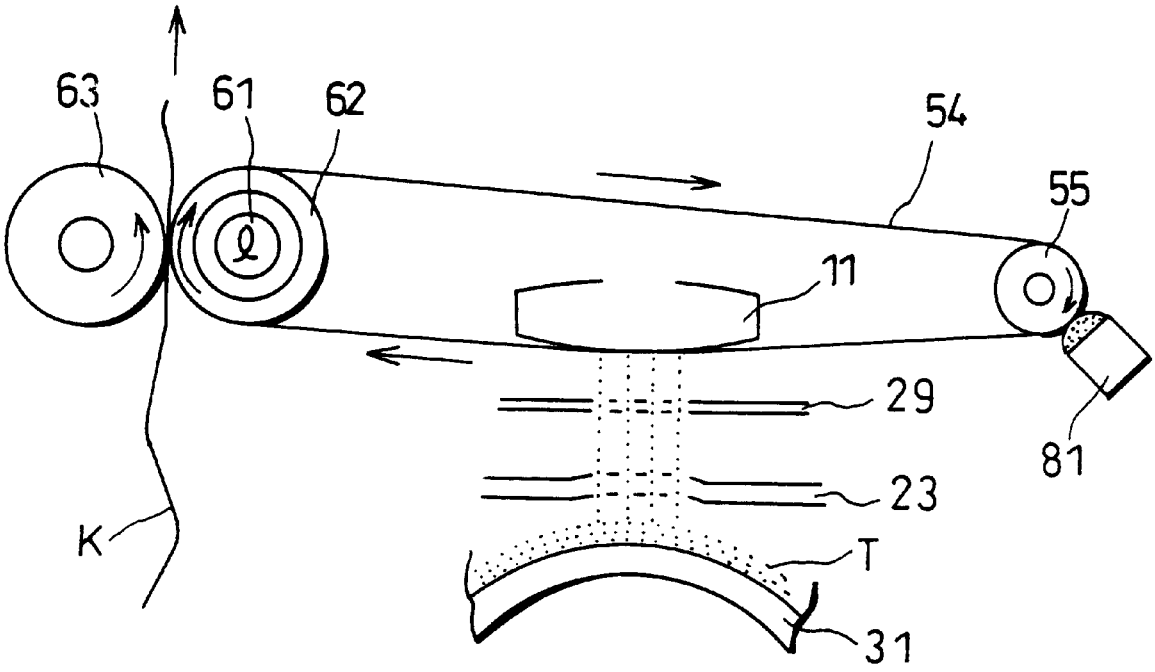
FIG. 18 is a drawing schematically showing the structure of an image forming device in which a transfer material is made up of a transfer belt.

As shown in FIG. 2, in the image forming device according to the present embodiment, a printing section 1 controls supply of toner from a toner supply section 3 in accordance with image signals so as to form a toner image on a transfer material, and typical copy paper is used for the transfer material. However, there is no limitation to this structure; alternatively, a structure may be used in which, as shown in FIG. 18, a toner image is first formed on a transfer belt 54 (endless member) and then transferred to a recording material K (final recording material), which is a sheet of paper.

In the image forming device (e.g., printer) according to the present embodiment, as shown in FIG. 2, a paper supply section 4 is provided upstream, with respect to the direction of transport of the transfer material, from the printing section 1.

The paper supply section 4 is made up of a paper cassette 41, which stores transfer material P (to be discussed below); a pickup roller 42, which sends the transfer material P out of the paper cassette 41 one sheet at a time; and a pair of resist rollers 43, which transport supplied transfer material P in synchronization with the timing of printing.

Figure 3:
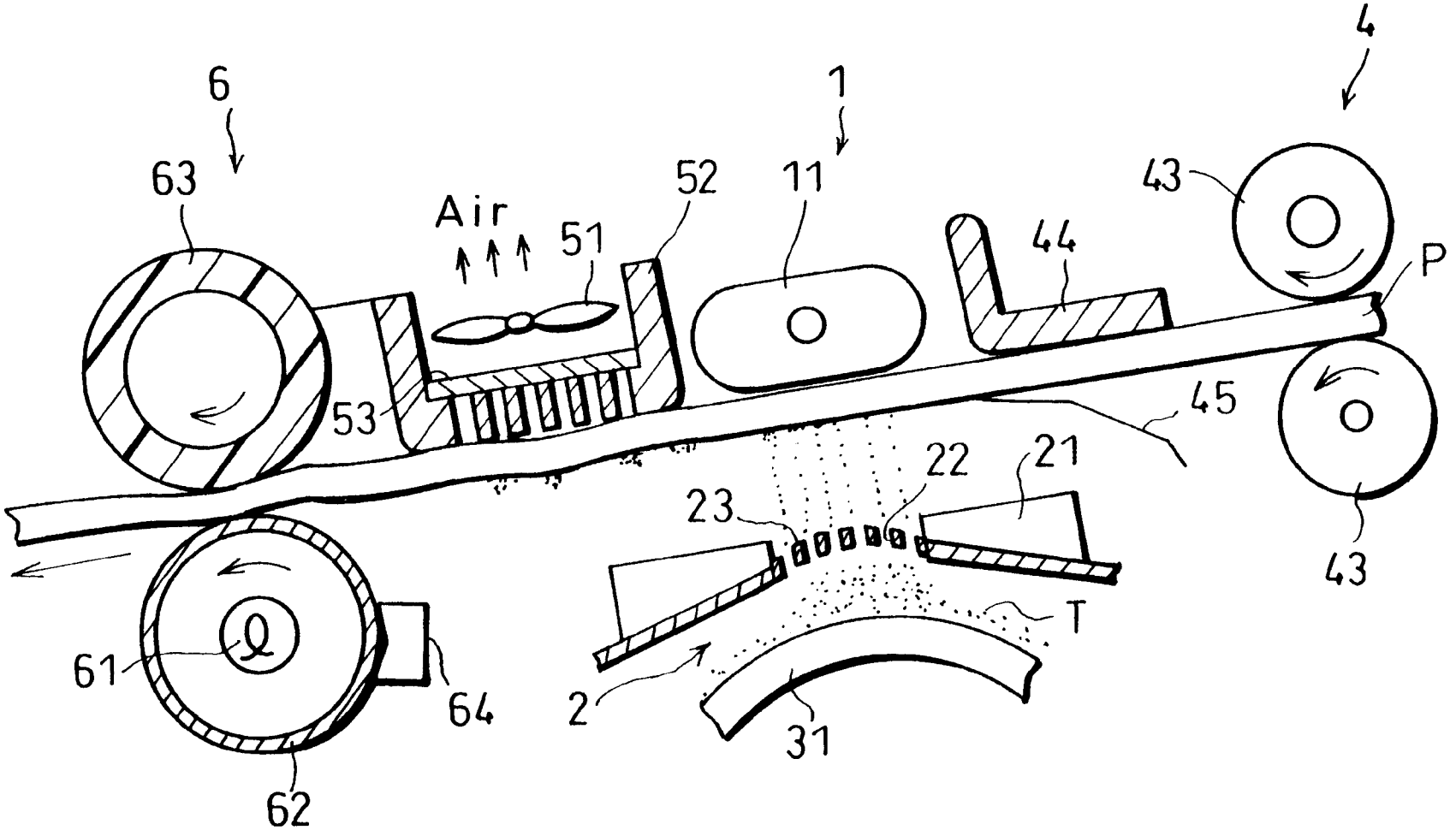
FIG. 3 is a drawing schematically showing the structure of a printing section and a jet control section of the foregoing image forming device.

After passing between the resist rollers 43, as shown in FIG. 3, the transfer material P is guided to the printing section 1 by a paper guide plate 44 and a paper pressure plate 45. At this time, a paper supply sensor (not shown) provided in the paper supply section 4 detects the transfer material P supplied to the printing section 1.

The pickup roller 42 and the resist rollers 43 are rotated by a driving apparatus (not shown) in accordance with driving signals from a controller section 7 shown in FIG. 2.

Downstream from the printing section 1 with respect to the transport direction of the transfer material P are provided a transport guide plate 52, and a fixing section 6, which, by applying heat and pressure, fixes on the transfer material P a toner image formed thereon by the printing section 1.

The transport guide plate 52 is provided with a fan 51 and a filter 53, and blows air away from the transfer material P while guiding it toward the fixing section 6.

The fixing section 6, as shown in FIG. 3, is made up of a heat roller 62 containing a heater 61, a pressure roller 63, and a temperature sensor 64.

"The heat roller 62 is made of, for example, an aluminum tube of 2 mm thickness. The heater 61 is, for example, a halogen lamp, and is provided inside the heat roller 62. The pressure roller 63 is made of, for example, silicone resin."

Further, the heat roller 62 and the pressure roller 63, provided opposite one another, are placed under a load of, for example, 2 kg by means of, e.g. springs (not shown) provided at the ends of respective axles thereof, so that pressure can be applied to the transfer material P held therebetween. Incidentally, the heat roller 62 and the pressure roller 63 are rotated by a driving apparatus (not shown).

The heat sensor 64 measures the temperature of the surface of the heat roller 62. Measured values are sent to a temperature control section (not shown) of the controller section 7. The temperature control section maintains the temperature of the heat roller 62 at, for example, 150° C. by ON/OFF control of the heater 61 in accordance with the surface temperature of the heat roller 62 as measured by the temperature sensor 64.

The fixing section 6 is also provided with a discharge sensor (not shown), which detects discharge of the transfer material P. Incidentally, the materials of the heater 61, the heat roller 62, and the pressure roller 63 are not particularly limited. Neither is the surface temperature of the heat roller 62 particularly limited. Furthermore, the fixing section 6 may alternatively be structured so as to transfer and fix a toner image formed on a transfer belt 54 (to be discussed below) to a recording material K (to be discussed below) by applying heat and pressure to the transfer belt 54 and the recording material K.

Further, although not shown in the Figures, discharge rollers for discharging to the exterior of the device transfer material P processed by the fixing section 6, a discharge tray for holding the discharged transfer material P, etc., may, as needed, be provided in the direction of discharge of the transfer material P from the fixing section 6, depending on the shape of the image forming device, the direction of discharge of the transfer material P, etc.

Figure 4:
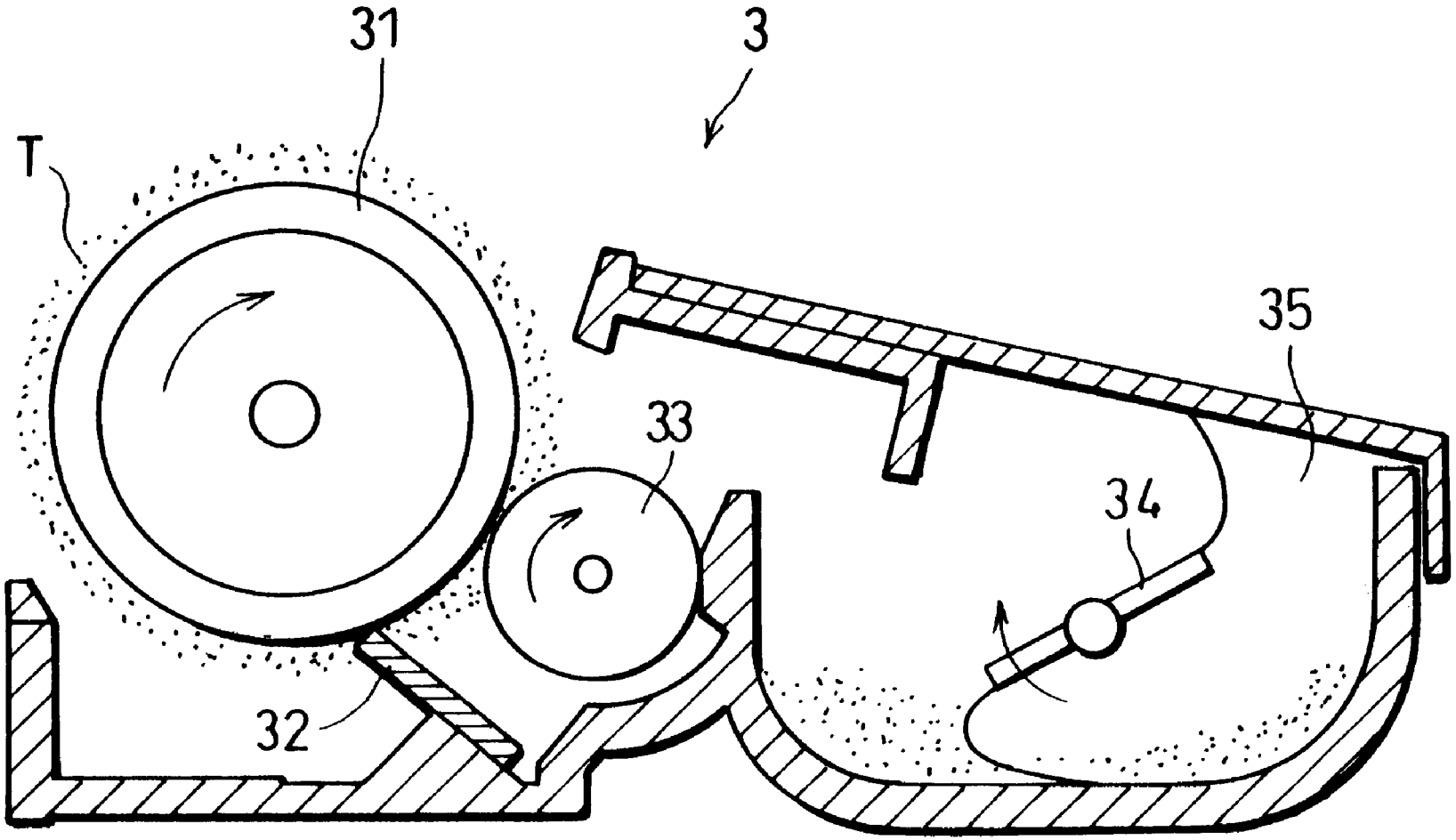
FIG. 4 is a drawing schematically showing the structure of a toner supply section of the foregoing image forming device.

The toner supply section 3, as shown in FIG. 2, is provided below the printing section 1, and, as shown in FIG. 4, is made up of a toner reservoir 35 containing toner T; a stirring roller 34 which, by stirring the toner T inside the toner reservoir 35, prevents uneven distribution of the toner T therein; a toner carrier 31, which carries and transports the toner T; a toner layer regulating member 32, which regulates the thickness of a toner layer formed on the toner carrier 31; and a supply roller 33, which charges the toner T and supplies it to the toner carrier 31.

The toner T, made up of ca. 10 $\mu$m particles chiefly composed of, for example, styrene acrylic, is contained in the toner reservoir 35, and is pushed toward the toner carrier 31 by rotation of the stirring roller 34.

The toner carrier 31 is connected to a driving apparatus (not shown), and rotates in the direction of the arrow (FIG. 4) at a surface speed of, for example, 50 mm/sec. On the surface of the toner carrier 31 are formed irregularities of several $\mu$m, and the toner T is supplied to the toner carrier 31 by means of friction of between the supply roller 33 and the surface of the toner carrier 31. Further, the toner T on the surface of the toner carrier 31 is formed into a toner layer of a predetermined thickness by the toner layer regulating means 32.

Figure 5:
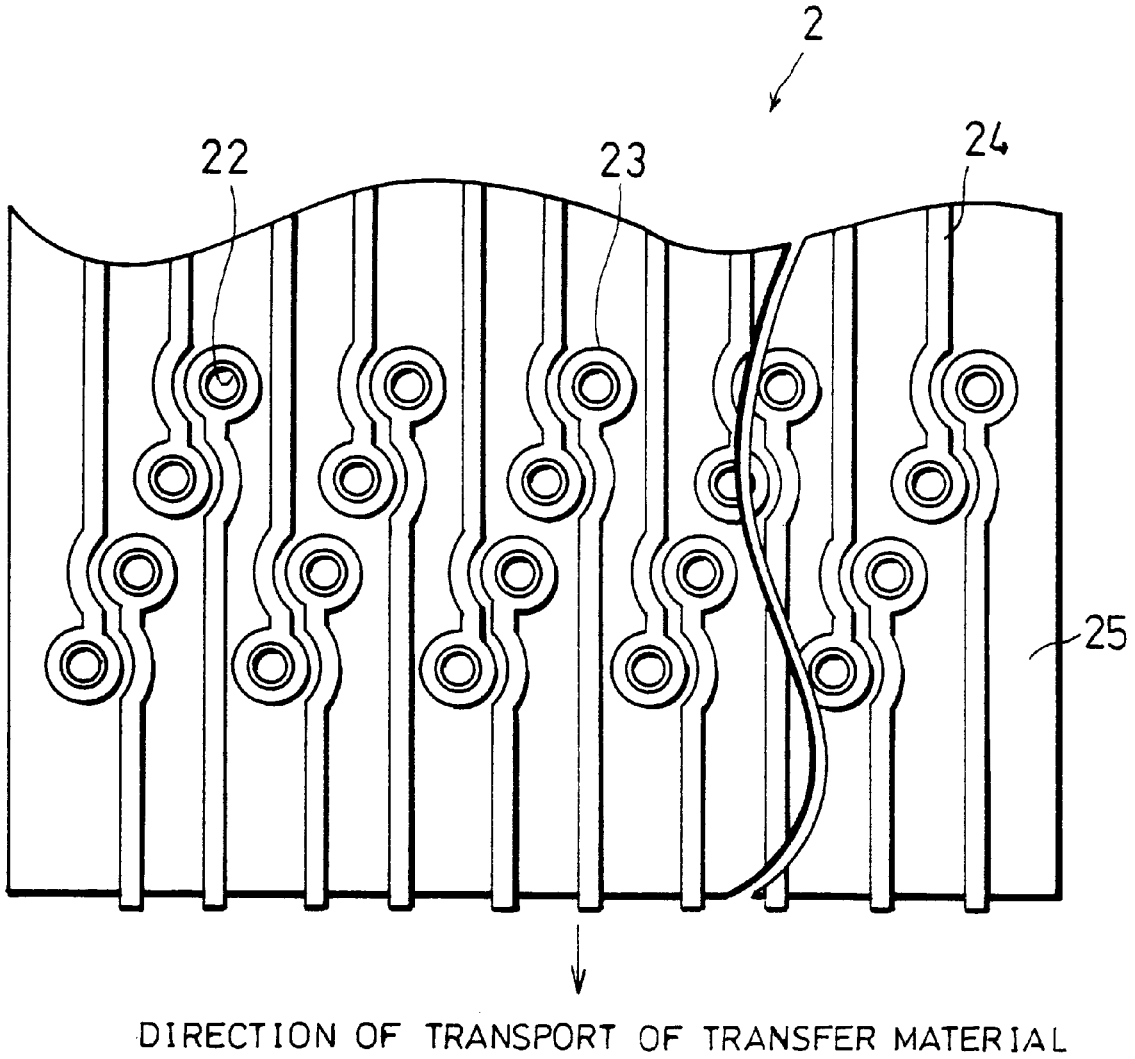
FIG. 5 is a plan view showing the jet control section of the foregoing image forming device.

The printing section 1, as shown in FIG. 3, is made up of a jet control section 2 (control means) provided opposite the outer surface of the toner carrier 31, and a counter electrode 11. As shown in FIG. 5, the jet control section 2 selectively controls passage of the toner T from the toner carrier 31 through gates 22 toward the counter electrode 11 by application of a voltage to a layer of ring-shaped control electrodes 23 in accordance with image signals.

When printing, a sheet of transfer material P stored in the paper cassette 41 (shown in FIG. 2) is sent out by the pickup roller 42 based on a begin print signal from the controller section 7, and transported by the resist rollers 43. As shown in FIG. 3, the transfer material P transported by the resist rollers 43 is held against the counter electrode 11 by the paper guide plate 44 and the paper pressure plate 45.

Figure 1:
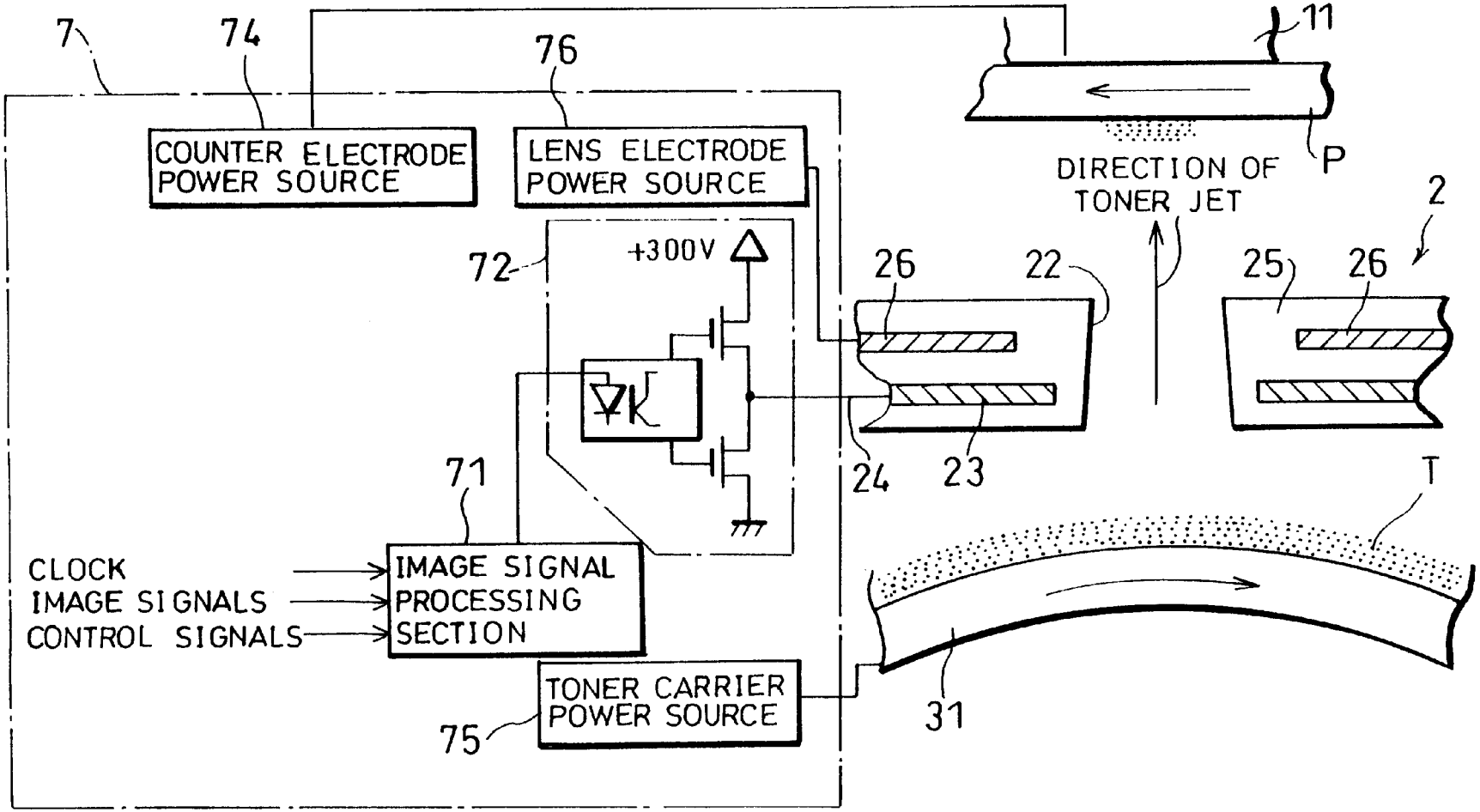
FIG. 1 is an explanatory drawing showing an image forming device according to one embodiment of the present invention.

The counter electrode 11 is provided at a distance of, for instance, 1 mm from the toner carrier 31. Further, as shown in FIG. 1, a counter electrode power source 74 applies a high voltage of, for instance, 2 kV to the counter electrode 11 during printing operations. In other words, the voltage applied to the counter electrode 11 by the counter electrode power source 74 forms, between the counter electrode 11 and the toner carrier 31, an electrical field sufficient to cause the toner T on the toner carrier 31 to jet toward the counter electrode 11.

As shown in FIG. 1, the controller section 7 (voltage applying means) includes the counter electrode power source 74; a control electrode driver 72; a toner carrier power source 75; an image signal processing section 71, which produces image signals for jet control based on a clock, image signals, and control signals; and a main control section (not shown), which controls the image forming device as a whole.

Figure 16:
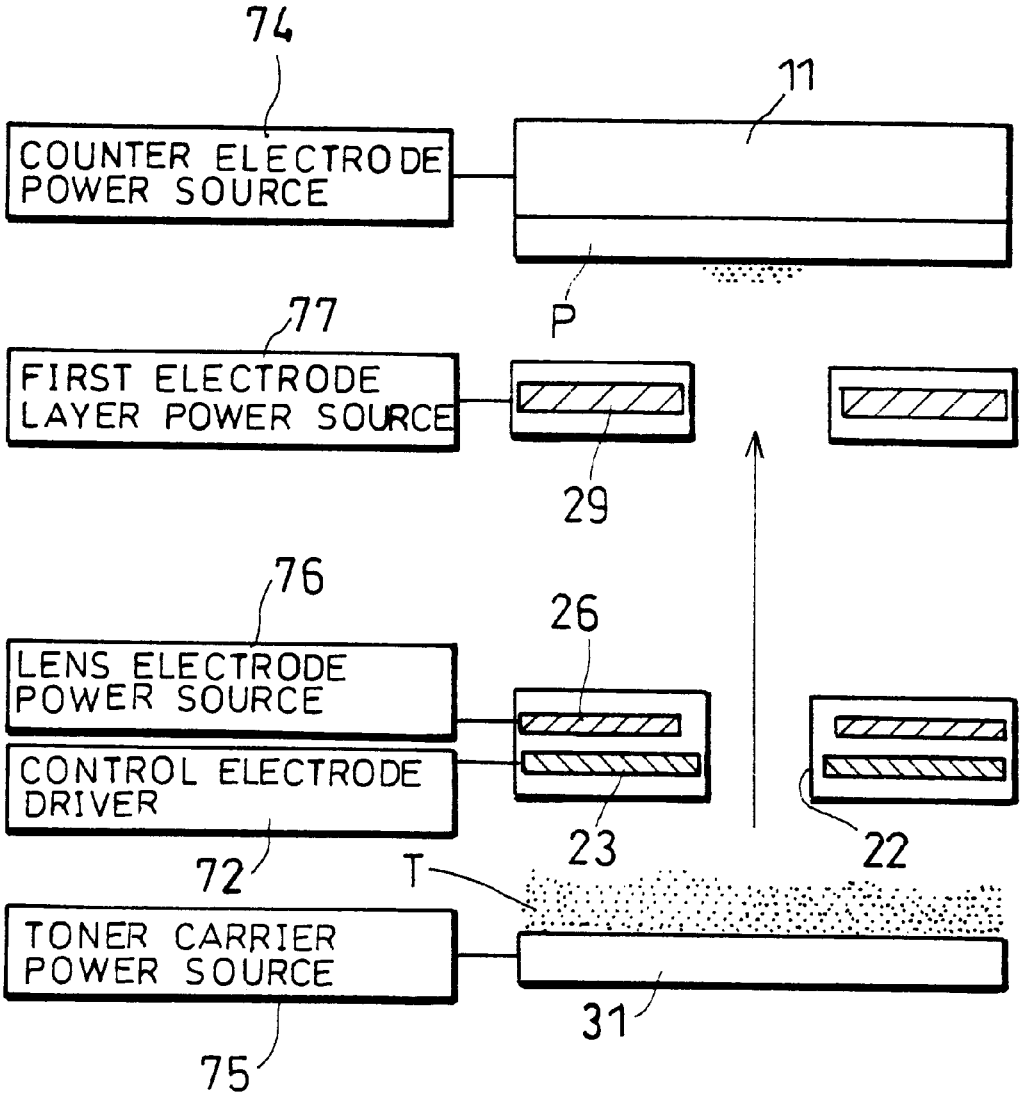
FIG. 16 is a drawing schematically showing the structure of a jet control section provided with a first electrode layer, provided in the foregoing image forming device.

Further, depending on the electrode structure of the control means (jet control section 2), the controller section 7 is provided with a lens electrode power source 76 (shown in FIG. 1), a row electrode driver 73 (shown in FIG. 11), and/or a first electrode layer power source 77 (shown in FIG. 16).

The jet control section 2, as shown in FIG. 1, is provided between the counter electrode 11 and the toner carrier 31, extending two-dimensionally substantially parallel with the counter electrode 11, and is structured so that the toner T can pass from the toner carrier 31 toward the counter electrode 11. By means of a potential applied to the control electrodes 23 by the control electrode driver 72, the electrical field acting on the toner layer on the toner carrier 31 changes, thus controlling the jet of toner T from the toner carrier 31 toward the counter electrode 11.

As shown in FIG. 3, the control electrodes 23 are provided at a distance of, for instance, 150 $\mu$m from the outer surface of the toner carrier 31, and are fixed and supported by an electrode mounting 21.

Figure 6:
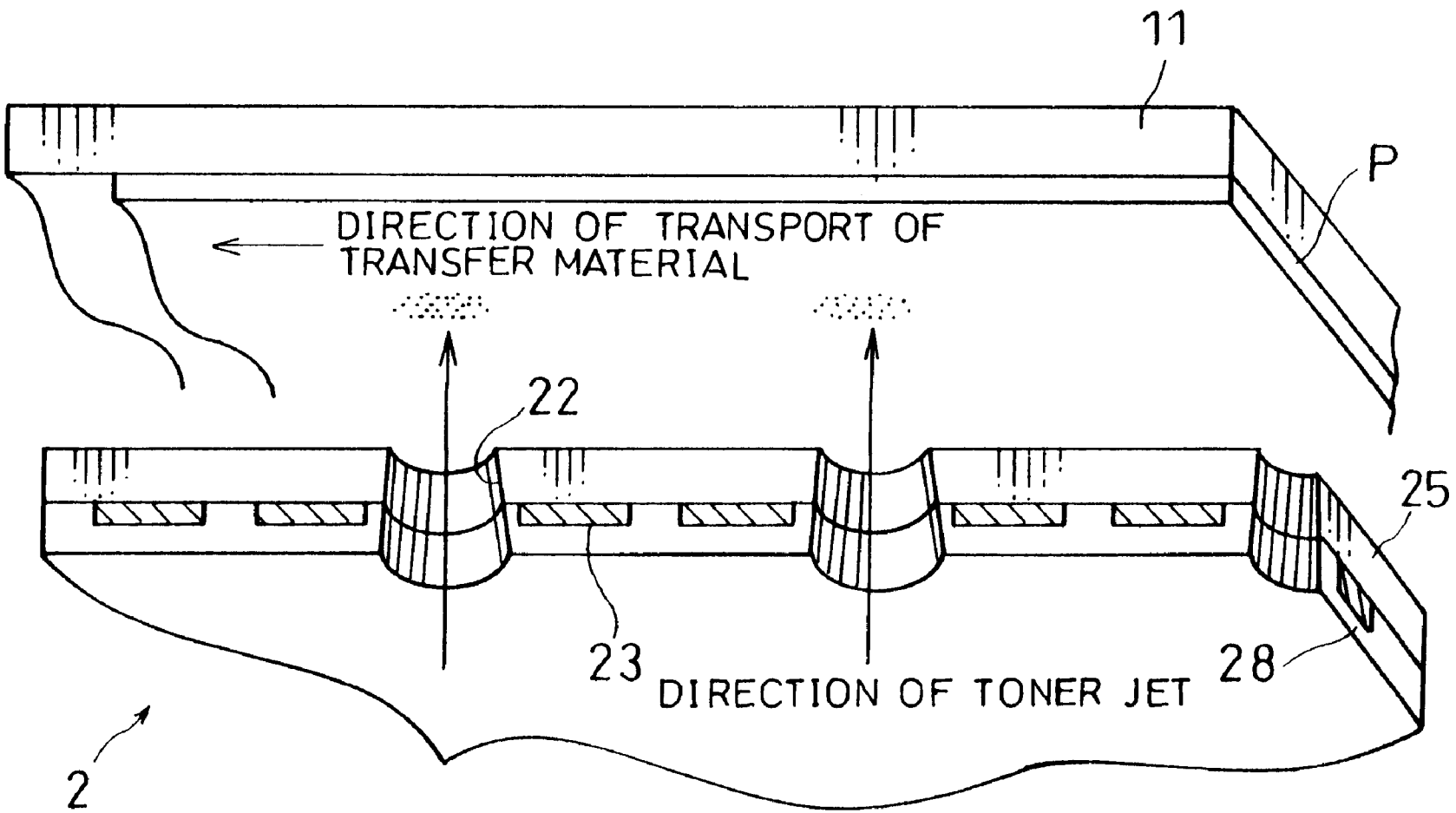
FIG. 6 is a perspective view showing a jet control section structured of a layer of control electrodes only, provided in the foregoing image forming device.
Figure 7:
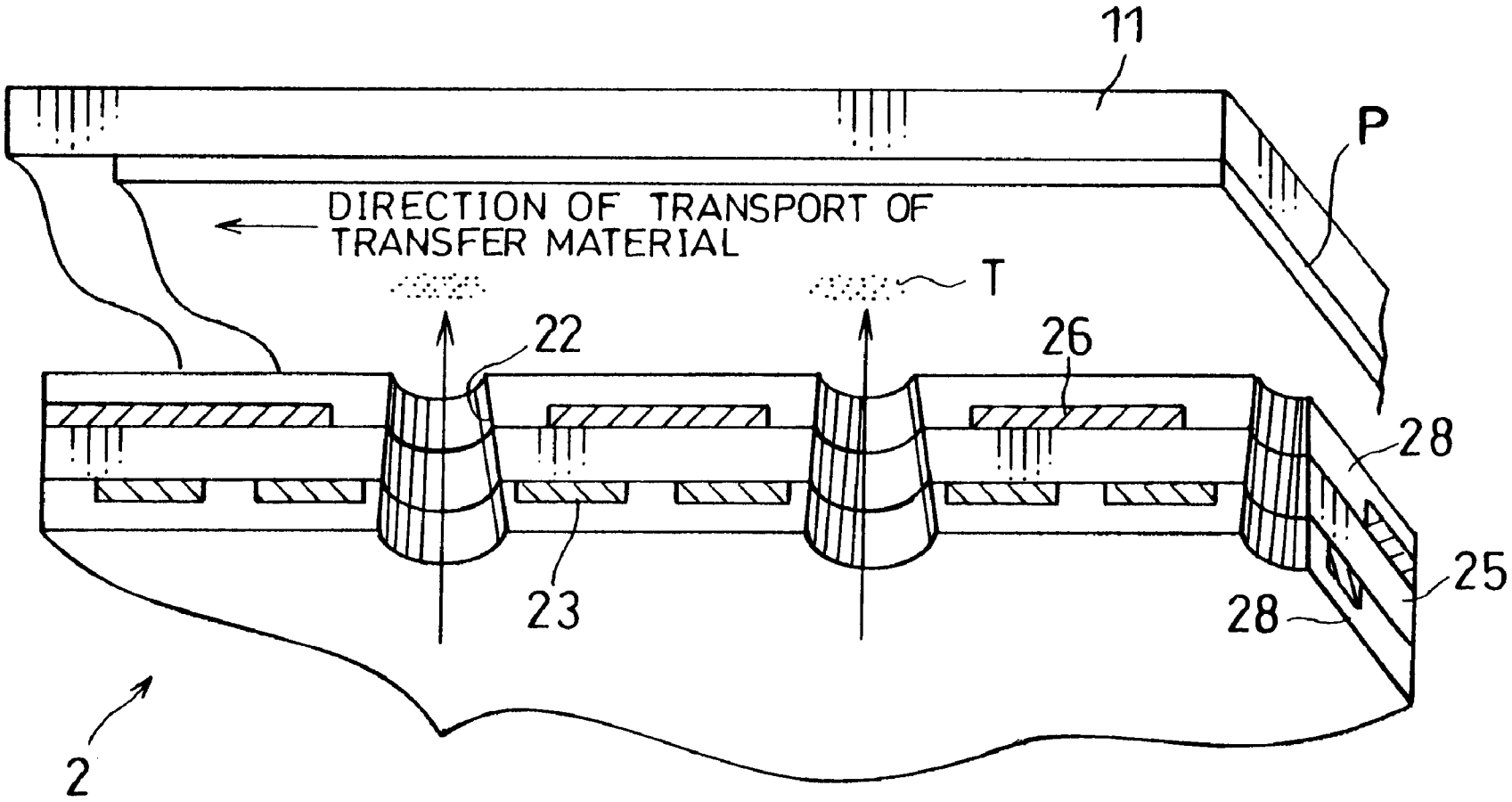
FIG. 7 is a perspective view showing a jet control section structured of a layer of control electrodes and a layer of lens electrodes, provided in the foregoing image forming device.
Figure 8:
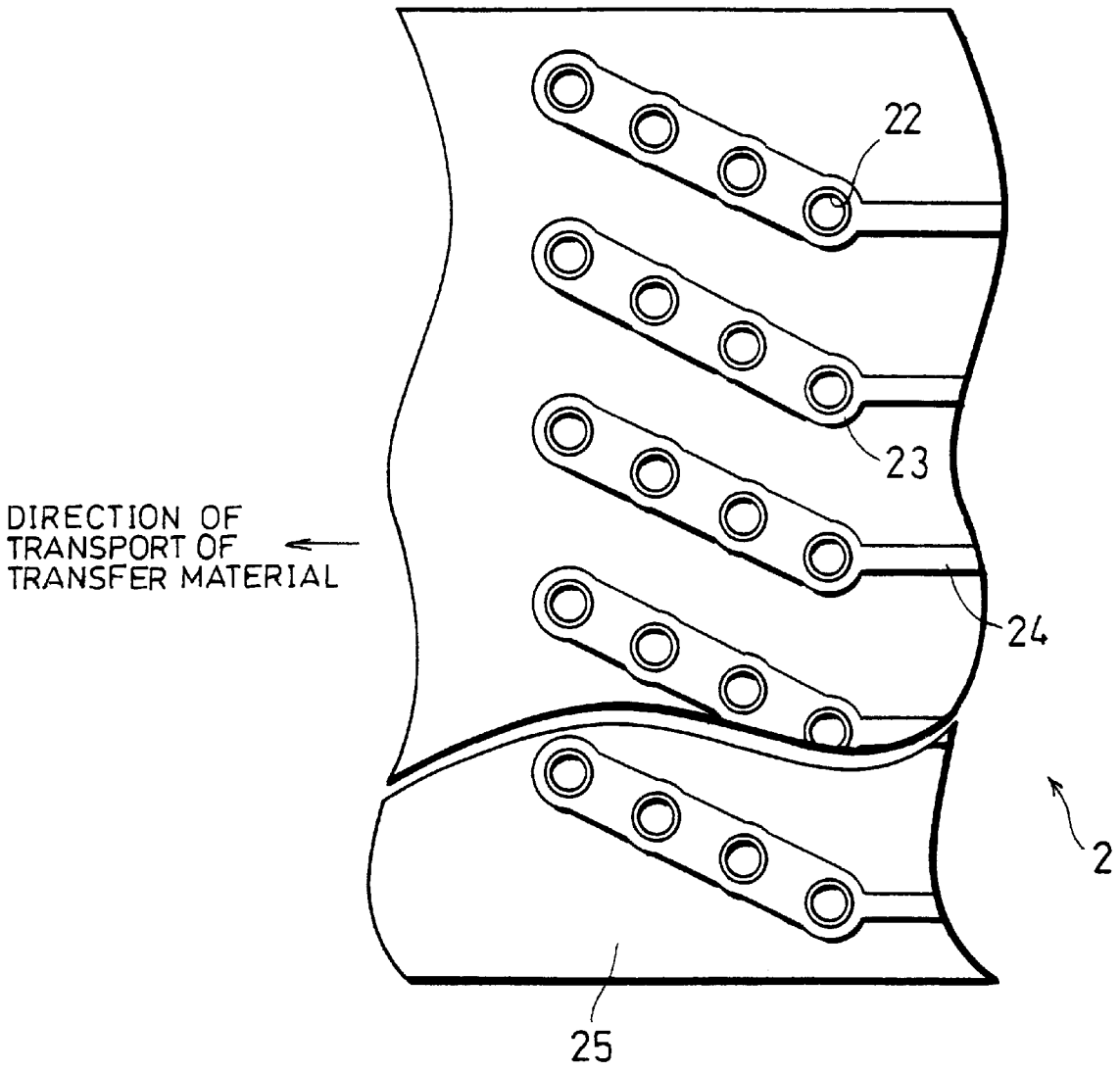
FIG. 8 is a plan view showing only the control electrodes of a jet control section structured of a layer of control electrodes and a layer of row electrodes, provided in the foregoing image forming device.
Figure 9:
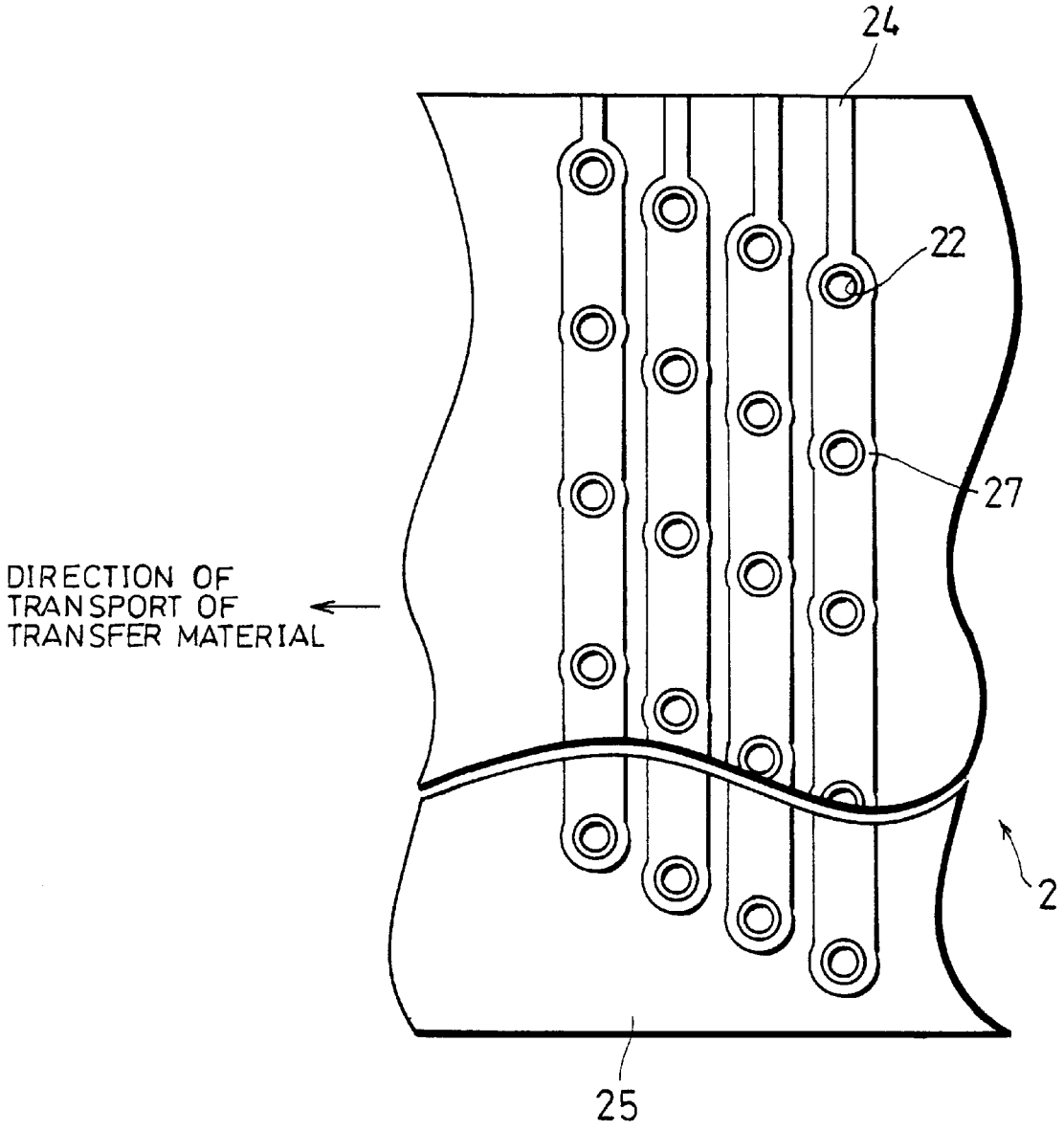
FIG. 9 is a plan view showing only the row electrodes of a jet control section structured of a layer of control electrodes and a layer of row electrodes, provided in the foregoing image forming device.
Figure 10:
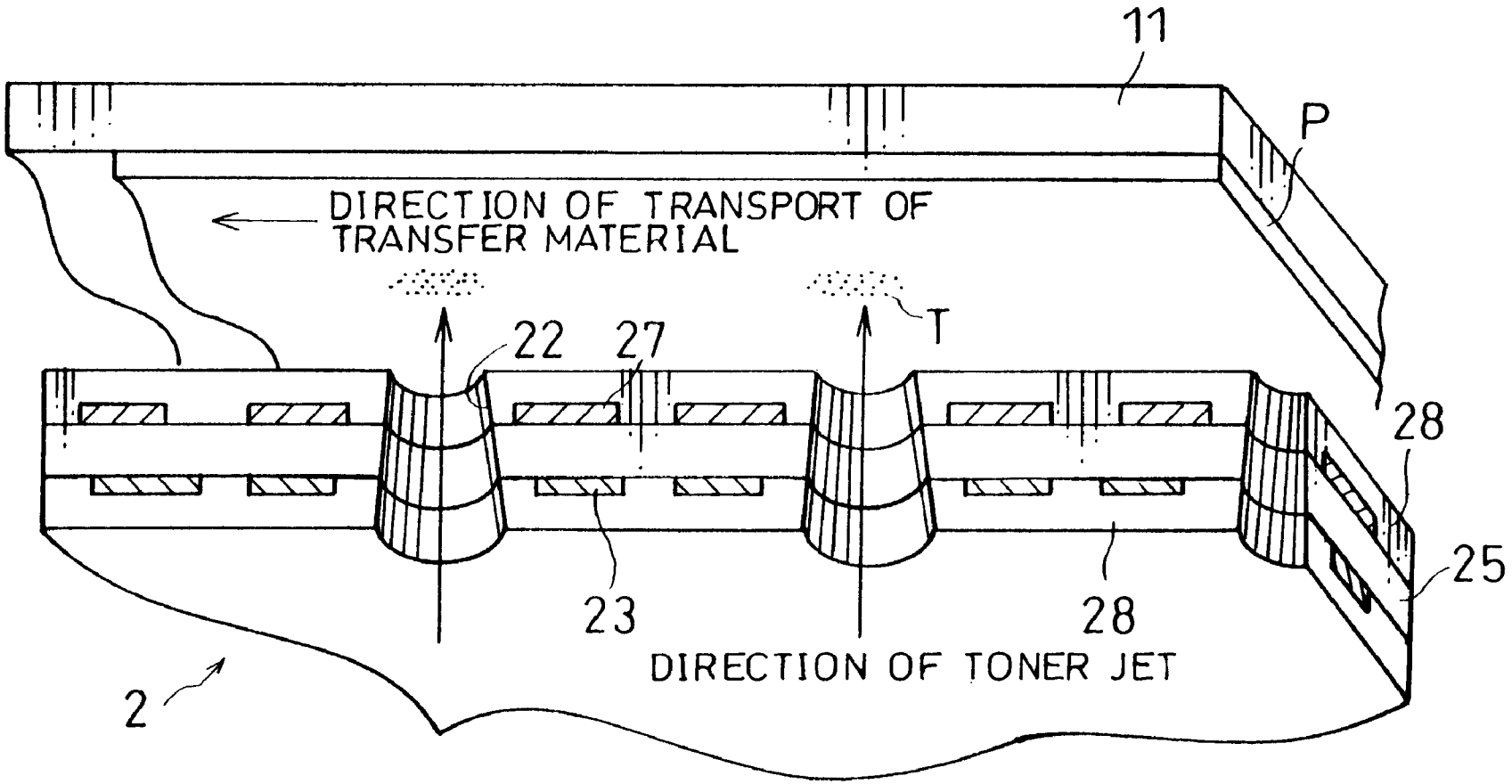
FIG. 10 is a perspective view showing a jet control section structured of a layer of control electrodes and a layer of row electrodes, provided in the foregoing image forming device.
Figure 11:
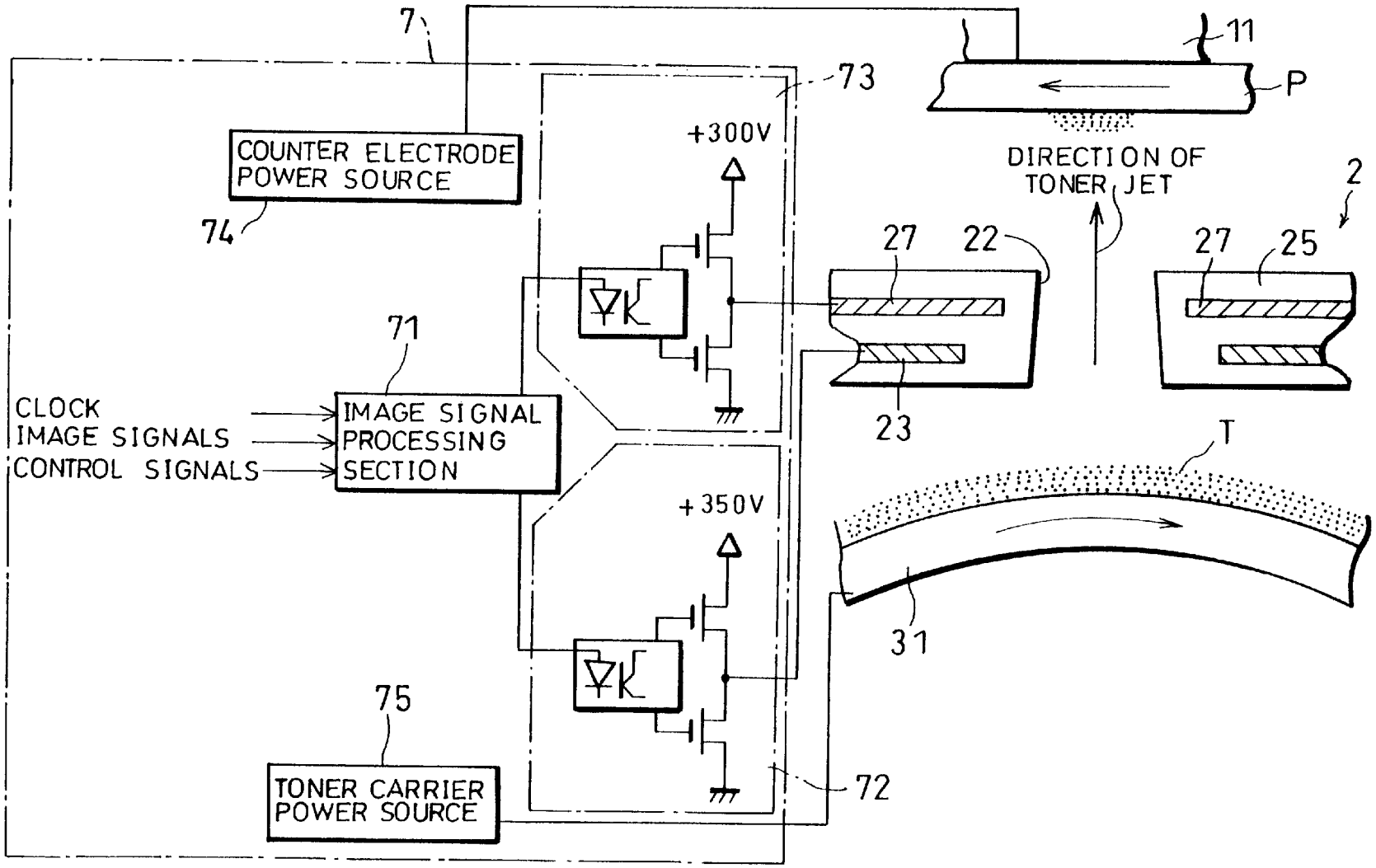
FIG. 11 is an explanatory drawing showing a jet control section structured of a layer of control electrodes and a layer of row electrodes, provided in the foregoing image forming device.

The jet control section 2 may be structured as shown in FIG. 6, of a single electrode layer, i.e., of control electrodes 23, provided on a base layer 25 (insulating layer) and protected by a cover layer 28. Alternatively, the jet control section 2 may be structured as shown in FIG. 7, of a plurality of electrode layers, i.e., a layer of control electrodes 23 and a layer of lens electrodes 26, separated from each other by a base layer 25 (insulating layer), with cover layers 28 protecting each electrode layer.

The base layer 25 is made of, for example, polyimide resin 25 $\mu$m in thickness. The base layer 25 and the cover layer(s) 28 are penetrated by holes which form the gates 22.

The control electrodes 23 are made of, for example, copper film 18 $\mu$m in thickness, and are provided in a predetermined arrangement in the shape of rings with diameters of, for example, 200 $\mu$m, so as to encircle each of the foregoing holes. The respective holes have diameters of, for example, 160 $\mu$m, and are spaces which allow passage of the jet of toner T from the toner carrier 31 toward the counter electrode 11. These spaces are the gates 22. Incidentally, the distance between the control electrodes 23 and the toner carrier 31 is not particularly limited. Further, the respective diameters of the ring-shaped parts of the control electrodes and of the gates 22, and the materials and thicknesses of the insulating layer and of the control electrodes 23 are not particularly limited.

As shown in FIG. 5, each control electrode 23 is electrically connected to the control electrode driver 72 (see FIG. 1) by an electric wire 24. The control electrodes 23 are provided directly on the base layer 25, which is an insulating base material, thus ensuring insulation of the control electrodes 23 from each other, of the electric wires 24 from each other, of each control electrode 23 from electric wires 24 other than the one to which it is connected, and of the control electrodes 23 from the counter electrode 11.

The control electrode driver 72 (see FIG. 1) applies pulses, i.e., voltages corresponding to image signals to the control electrodes 23 of the jet control section 2. In other words, the control electrode driver 72 applies to a control electrode 23 a first potential (hereinafter referred to as an "ON potential") of, say, 300V when allowing toner T to pass through the gate 22 from the toner carrier 31 toward the counter electrode 11, and a second potential (hereinafter referred to as an "OFF potential") of, say, 0V when not allowing the toner T to pass through the gate 22. Incidentally, lens electrodes 26 (shown in FIG. 7), for adjusting the flow of toner T after it has passed the control electrodes 23, may be provided as needed on the other side of the base layer 25 from the control electrodes 23, facing the counter electrode 11. In the present invention, the lens electrodes 26 also serve to determine an electrical field between the lens electrodes 26 and the counter electrode 11 or a first electrode layer 29 (to be discussed below).

In this way, by controlling the potential applied to the control electrodes 23 in accordance with image signals, a toner image corresponding to the image signals can be formed on a sheet of transfer material P positioned on a side of the counter electrode 11 which faces the toner carrier 31. Incidentally, the control electrode driver 72 is controlled by control electrode control signals sent from an image forming control unit (not shown) of the controller section 7.

EXAMPLES

Example 1

The image forming device according to the present invention can be used as a printer for printing output from a computer, word processor, etc., and also as a printing section of a digital copy machine. The present Example will explain a case of use of the foregoing image forming device as a printer.

First, as shown in FIG. 1, image signals from, for example, a host computer (not shown) are sent to the controller section 7, and the controller section 7 separates the image signals into control signals (such as a begin print signal, a transfer material size detection signal, etc.) and image data.

Next, the pickup roller 42 (shown in FIG. 2) begins to rotate in response to a begin print signal, and a sheet of transfer material P is sent out from the paper cassette 41 until its leading edge comes in contact with the resist rollers 43 (shown in FIG. 3). At this time, rotation of the pickup roller 42 begins after a transfer material sensor (not shown) provided in the paper cassette 41 confirms that the paper cassette 41 contains transfer material P.

Next, the resist rollers 43 begin rotating at equal speed, and the transfer material P is pressed against the paper guide plate 44 by the paper pressure plate 45, and transported at a constant speed to a position opposite the counter electrode 11.

In synchronization with the commencement of rotation of the resist rollers 43, the image forming control unit of the controller section 7 begins processing of the image signals. Since the leading edge of the transfer material P is in contact with the resist rollers 43 when they begin rotating, the image forming control unit calculates a distance from the leading edge of the transfer material P to an image formation position, enabling printing at a predetermined position on the transfer material P.

Next, operations of the jet control section 2 will be explained.

In the toner supply section 3 (shown in FIG. 4), the toner T is given a charge of a predetermined polarity by friction with the supply roller 33 and by friction with the toner layer regulating member 32. In the present Example, the toner T is given a negative charge. Next, as shown in FIG. 3, the toner T is transported by rotation of the toner carrier 31 to a position opposite the gates 22 of the jet control section 2. The toner carrier power source 75 (shown in FIG. 1) applies a predetermined voltage to the toner carrier 31 while it is in rotation.

Then, if the control electrode driver 72 applies a printing voltage (the ON potential; 350V in the present Example) to a given control electrode 23, toner T on the toner carrier 31 jets toward the gate 22 corresponding to that control electrode 23. Here, the electrical field from the counter electrode 11 extends toward the toner carrier 31, through the gate 22, which is a hole. Thus, of the toner T jetting toward the control electrode 23, toner T which is close to the gate 22 passes through the gate 22 and jets toward the counter electrode 11, thus forming a toner image on the transfer material P moving across the counter electrode 11.

If, on the other hand, a non-printing voltage (the OFF potential; 0V in the present Example) is applied to a given control electrode 23, an electrical field is formed from the control electrode 23 toward the toner carrier 31, and the jet electrical field toward the counter electrode 11 is completely blocked at the gate 22.

In the present Example, using a jet control section 2 (control means) structured of a single layer of control electrodes 23 (as shown in FIG. 6), conditions for optimum image quality of the toner image formed on the transfer material P were investigated by changing the voltage applied to the counter electrode 11 and the distance between the control electrodes 23 and the counter electrode 11.

With a distance between the toner carrier 31 and the control electrodes 23 set to 150 $\mu$m, and the control electrode driver 72 applying to the control electrodes 23 an ON potential of 350V and an OFF potential of 0V, pixels were formed, yielding the results shown in Table 1 below.

TABLE 1

| | CONDITIONS | | | | | | | |
|---|---|---|---|---|---|---|---|---|
| | 1 | | 2 | | 3 | | 4 | |
| | ON | OFF | ON | OFF | ON | OFF | ON | OFF |
| COUNTER ELECTRODE POTENTIAL (V) | 1250 | 1250 | 1250 | 1250 | 1500 | 1500 | 2000 | 2000 |
| CONTROL ELECTRODE POTENTIAL (V) | 350 | 0 | 350 | 0 | 350 | 0 | 350 | 0 |
| TONER CARRIER POTENTIAL (V) | 20 | 20 | 20 | 20 | 20 | 20 | 20 | 20 |
| CONTROL-COUNTER ELECTRODE DISTANCE d (μm) | 700 | 700 | 500 | 500 | 500 | 500 | 700 | 700 |
| TONER CARRIER-COUNTER ELECTRODE POTENTIAL DIFFERENCE VH (V) | 1230 | 1230 | 1230 | 1230 | 1480 | 1480 | 1980 | 1980 |
| ELECTRICAL FIELD INTENSITY EH NEAR COUNTER ELECTRODE (kV/mm) | 1.29 | 1.79 | 1.80 | 2.50 | 2.30 | 3.00 | 2.36 | 2.86 |
| IMAGE QUALITY | POOR | | FAIR | | GOOD | | POOR | |

In Table 1, VH is a potential difference between the toner carrier 31 and the counter electrode 11, and EH is the intensity of the electrical field in the vicinity of the counter electrode 11. Further, the electrical field intensity EH is calculated as follows.

$$EH = \frac{\text{(potential difference between control electrodes 23 and counter electrode 11)}}{\text{(distance } d \text{ between control electrodes 23 and counter electrode 11)}}$$

Image quality was evaluated as follows. When there was almost no scattering, and converged pixels were formed, image quality was rated "Good." When there was little scattering, converged pixels were formed, and image quality when printing lines, characters, etc. was not inferior to that of image forming devices not of the toner jet type (typical image forming devices using the electrophotographic process, for example), image quality was rated "Fair." When there was marked scattering, and the boundaries of pixels were unclear, image quality was rated "Poor."

As shown in Table 1, satisfactory results were obtained under Conditions 2 and Conditions 3. Here, the potential difference VH between the toner carrier 31 and the counter electrode 11 and the electrical field intensity EH in the vicinity of the counter electrode 11 were preferably VH≦1480V and EH≧1.80 kV/mm, respectively, and, although not shown in Table 1, were preferably VH ≦1.5 kV and EH≧1.8 kV/mm, respectively.

In this way, in the present Example 1, the inventors found that a converged toner image with little scattering could be formed by setting a potential difference VH between the toner carrier 31 and the counter electrode 11 (which influences toner jet speed when striking the transfer material P) to no more than 1.5 kV, and by setting an electrical field intensity EH in the vicinity of the counter electrode 11 (which also influences toner jet speed when striking the transfer material P) to no less than 1.8 kV/mm.

When, as in the present Example, the control means are structured of a single layer of control electrodes 23, the potential difference between the control electrodes 23 and the counter electrode 11 and the electrical field intensity EH in the vicinity of the counter electrode 11 fluctuate in accordance with the ON potential and the OFF potential, but if the foregoing conditions are satisfied, a converged toner image with little scattering can be obtained.

Example 2

In the present Example, the jet control section 2 (control means) was structured, as shown in FIGS. 8 through 11, of a layer of control electrodes 23 and a layer of row electrodes 27, provided on opposite sides of a base layer 25 extending in mutually intersecting directions. The control electrode driver 72 applies predetermined ON and OFF potentials to the control electrodes 23 in accordance with image signals, and a row electrode driver 73 sequentially applies an ON potential to one row electrode 27 at a time once every predetermined cycle. Voltages applied to the respective electrodes were determined such that a given gate 22 allows passage of the toner T only when ON potentials are applied to both the control electrode 23 and the row electrode 27 which intersect at the gate 22 in question. The respective voltages were set as follows.

Control electrodes 23:

ON potential 300 V/OFF potential 0V

Row electrodes 27:

ON potential 350V/OFF potential 0V

With the respective voltages set as above, and a distance between the toner carrier 31 and the row electrodes 27 set to 150 μm, pixels were formed, yielding the results shown in Table 2 below.

TABLE 2

| | CONDITIONS | | | | | | | |
|---|---|---|---|---|---|---|---|---|
| | 1 | | 2 | | 3 | | 4 | |
| | ON | OFF | ON | OFF | ON | OFF | ON | OFF |
| COUNTER ELECTRODE POTENTIAL (V) | 1250 | 1250 | 1250 | 1250 | 1500 | 1500 | 2000 | 2000 |
| ROW ELECTRODE POTENTIAL (V) | 350 | 0 | 350 | 0 | 350 | 0 | 350 | 0 |
| TONER CARRIER POTENTIAL (V) | 20 | 20 | 20 | 20 | 20 | 20 | 20 | 20 |
| CONTROL-COUNTER ELECTRODE DISTANCE d (μm) | 700 | 700 | 500 | 500 | 500 | 500 | 700 | 700 |
| TONER CARRIER-COUNTER ELECTRODE POTENTIAL DIFFERENCE VH (V) | 1230 | 1230 | 1230 | 1230 | 1480 | 1480 | 1980 | 1980 |
| ELECTRICAL FIELD INTENSITY EH NEAR COUNTER ELECTRODE (kV/mm) | 1.29 | 1.79 | 1.80 | 2.50 | 2.30 | 3.00 | 2.36 | 2.86 |
| IMAGE QUALITY | POOR | | FAIR | | GOOD | | POOR | |

As shown in Table 2, satisfactory results were obtained under Conditions 2 and Conditions 3. Here, the potential difference VH between the toner carrier 31 and the counter electrode 11 and the electrical field intensity EH in the vicinity of the counter electrode 11 were preferably VH≦1480V and EH≧1.80 kV/mm, respectively.

Further, although not shown in Table 2, the foregoing VH and EH were preferably VH≦1.5 kV and EH≧1.8 kV/mm, respectively.

As discussed above, in the present Example, the control means are structured of a layer of control electrodes 23 and a layer of row electrodes 27, extending in mutually intersecting directions, in which a given gate 22 formed at the intersection of a control electrode 23 and a row electrode 27 allows the passage of the toner T only when ON potentials are applied to both the control electrode 23 and the row electrode 27.

With the foregoing structure, since the total number of pixels is determined by the product of the number of electrodes in the electrode layers, the number of costly driver elements, for switching voltages applied to the control electrodes 23 and the row electrodes 27, can be greatly reduced.

In the present Example, since factors which influence the impact of the toner on the transfer material P, such as electrical field intensity and potential differences between the control electrodes 23 and row electrodes 27 and the counter electrode 11 are determined by the electrode layer of the control means closest to the counter electrode 11, i.e., by the row electrodes 27 alone, setting the potential difference VH and the electrical field intensity EH in the same ranges as in Example 1 above, i.e. to VH≦1.5 kV and EH≧1.8 kV/mm, respectively, can obtain the same effects as in Example 1, and a converged toner image with little scattering can be formed.

Example 3

Figure 12:
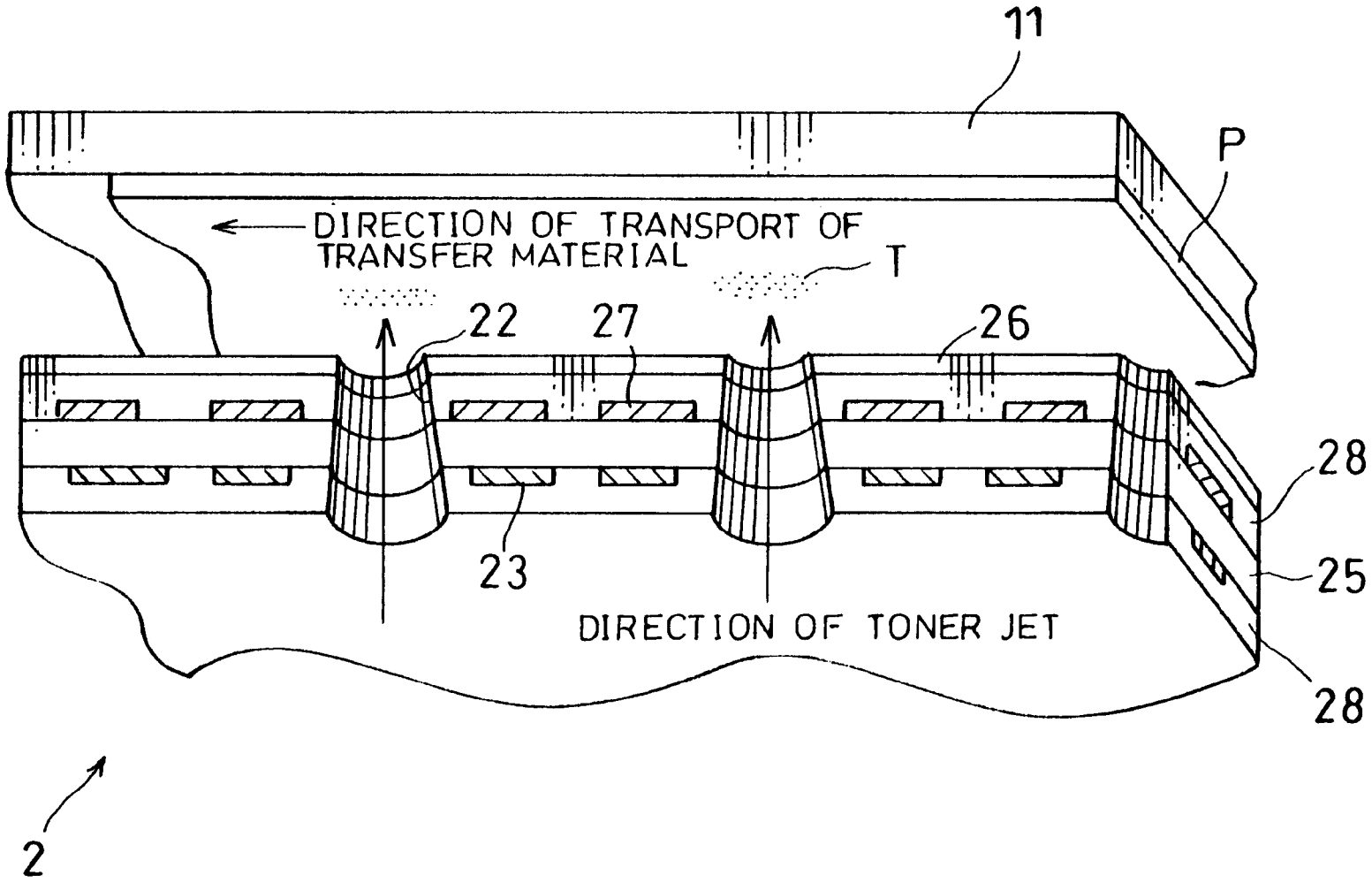
FIG. 12 is a perspective view showing a jet control section structured of a layer of control electrodes, a layer of row electrodes, and a layer of exposed lens electrodes, provided in the foregoing image forming device.

In the present Example, as shown in FIGS. 7 and 12, the jet control section 2 (control means) was provided with a layer of lens electrodes 26 on a surface thereof facing the counter electrode 11. With the lens electrode power source 76 (shown in FIG. 1) applying a predetermined voltage to the lens electrodes 26, the results shown in Table 3 below were obtained.

TABLE 3

| | CONDITIONS | | | | | | | |
|---|---|---|---|---|---|---|---|---|
| | 1 | | 2 | | 3 | | 4 | |
| | ON | OFF | ON | OFF | ON | OFF | ON | OFF |
| COUNTER ELECTRODE POTENTIAL (V) | 1000 | 1000 | 1000 | 1000 | 1500 | 1500 | 2000 | 2000 |
| ROW ELECTRODE POTENTIAL (V) | 350 | 0 | 350 | 0 | 350 | 0 | 350 | 0 |
| LENS ELECTRODE POTENTIAL (V) | 100 | 100 | 100 | 100 | 100 | 100 | 100 | 100 |
| TONER CARRIER POTENTIAL (V) | 20 | 20 | 20 | 20 | 20 | 20 | 20 | 20 |
| LENS-COUNTER ELECTRODE DISTANCE d (μm) | 700 | 700 | 500 | 500 | 500 | 500 | 700 | 700 |
| TONER CARRIER-COUNTER ELECTRODE POTENTIAL DIFFERENCE VH (V) | 980 | 980 | 980 | 980 | 1480 | 1480 | 1980 | 1980 |

TABLE 3-continued

| | CONDITIONS | | | | | | | |
|---|---|---|---|---|---|---|---|---|
| | 1 | | 2 | | 3 | | 4 | |
| | ON | OFF | ON | OFF | ON | OFF | ON | OFF |
| ELECTRICAL FIELD INTENSITY EH NEAR COUNTER ELECTRODE (kV/mm) | 1.29 | 1.29 | 1.80 | 1.80 | 2.80 | 2.80 | 2.71 | 2.71 |
| IMAGE QUALITY | POOR | | FAIR | | GOOD | | POOR | |

As shown in Table 3, satisfactory results were obtained under Conditions 2 and Conditions 3. Here, the potential difference VH between the toner carrier 31 and the counter electrode 11 and the electrical field intensity EH in the vicinity of the counter electrode 11 were preferably VH≦1480V and EH≧1.80 kV/mm, respectively, and, although not shown in Table 3, were preferably VH≦1.5 kV and EH≧1.8 kV/mm, respectively.

Figure 13:
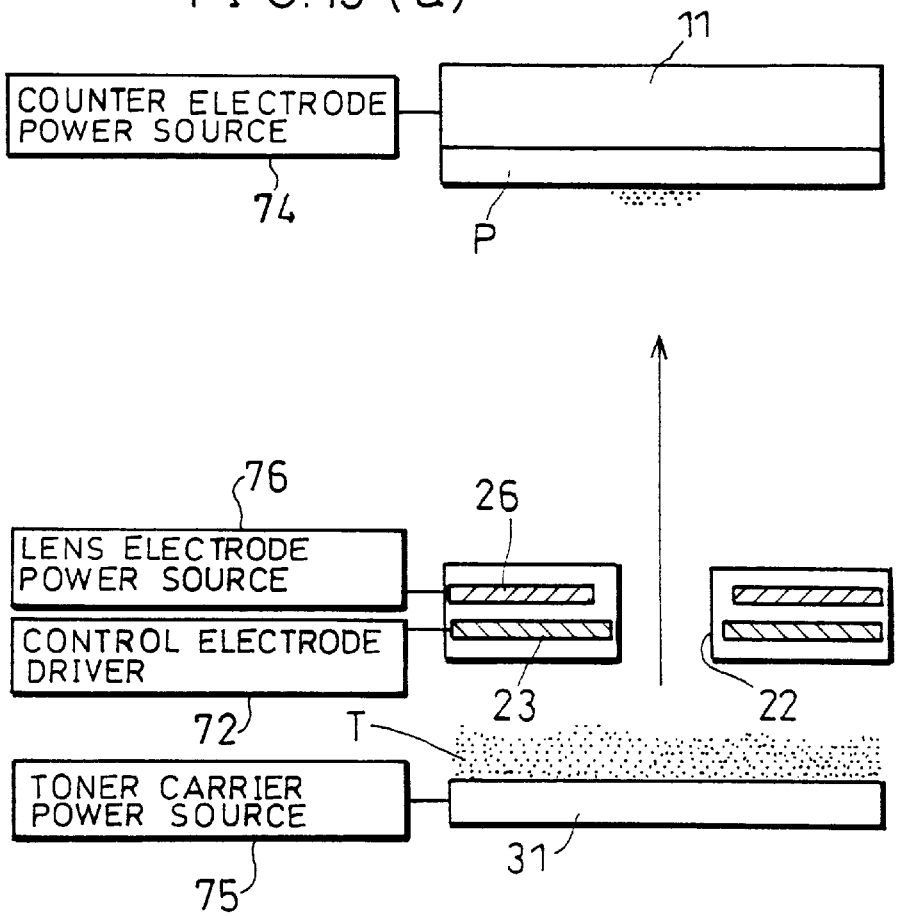
FIGS. 13(*a*) and 13(*b*) are drawings schematically showing the structure of a jet control section provided with lens electrodes, provided in the foregoing image forming device, with FIG. 13(*a*) showing a structure in which a counter electrode is positioned far from the lens electrodes, and FIG. 13(*b*) showing a structure in which a counter electrode is positioned close to the lens electrodes.
Figure 13:
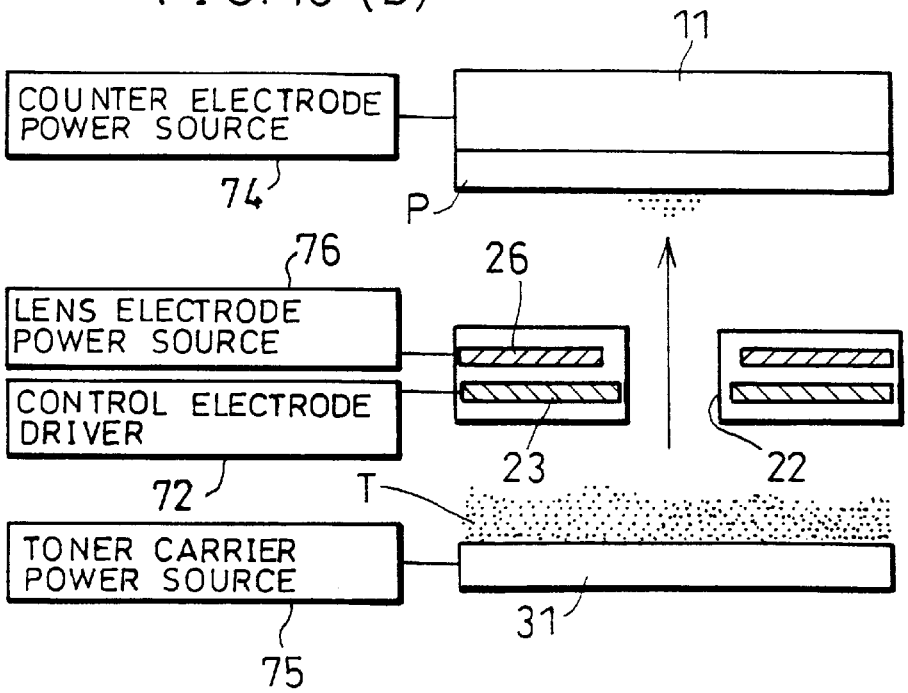

When, as shown in FIG. 7, the jet control section 2 is structured of a layer of control electrodes 23 and a layer of lens electrodes 26, the electrical field intensity EH in the vicinity of the counter electrode 11 is determined by the distance between the lens electrodes 26 and the counter electrode 11, as shown in FIGS. 13(*a*) and 13(*b*). Accordingly, by increasing the electrical field intensity EH by decreasing the distance between the lens electrodes 26 and the counter electrode 11, as shown in FIG. 13(*b*), and setting a small potential difference between the lens electrodes 26 and the counter electrode 11, it was possible to form good images with little scattering.

As discussed above, in the present Example, since the surface of the jet control section 2 facing the counter electrode 11 is provided with the lens electrodes 26, to which a fixed voltage can be applied, setting the potential difference VH between the toner carrier 31 and the counter electrode 11 and the electrical field intensity EH in the vicinity of the counter electrode 11 in the same ranges as in Examples 1 and 2 above, i.e. to VH≦1.5 kV and EH≧1.8 kV/mm, respectively, regardless of the voltage value of the control electrodes 23, can obtain the same effects as in Examples 1 and 2, and a converged toner image with little scattering can be formed, regardless of the voltage applied to the control electrodes 23 and the duration of voltage application.

Incidentally, by providing the lens electrodes 26 as shown in FIG. 12, exposed on the surface of the jet control section 2 facing the counter electrode 11, it is possible to prevent charging of the surface of the jet control section 2 when a paper jam, etc. causes the transfer material P to come into contact with the jet control section 2.

Example 4

Figure 14:
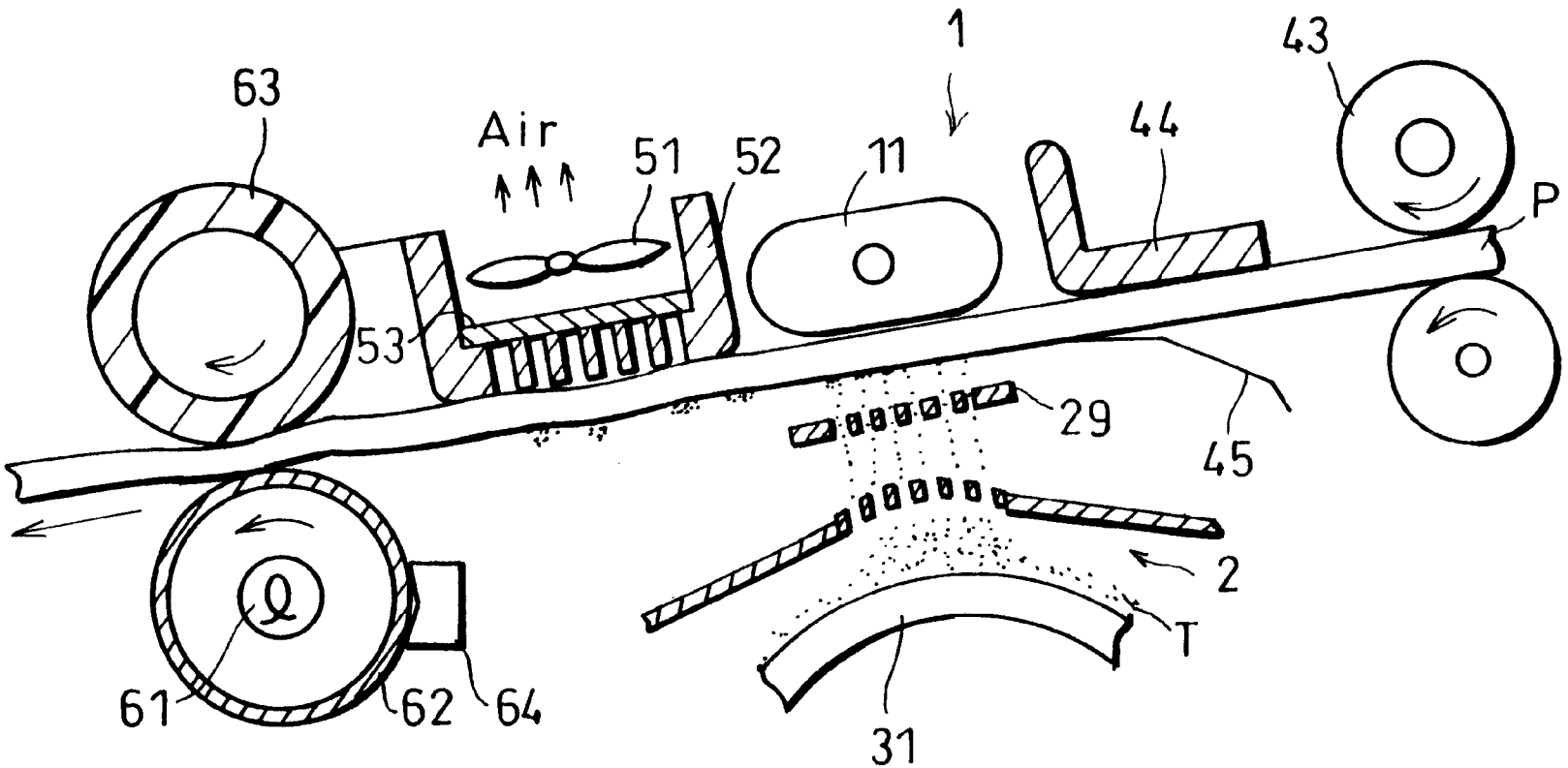
FIG. 14 is a drawing schematically showing the structure of a printing section and a jet control section provided with a first electrode layer, both provided in the foregoing image forming device.
Figure 15:
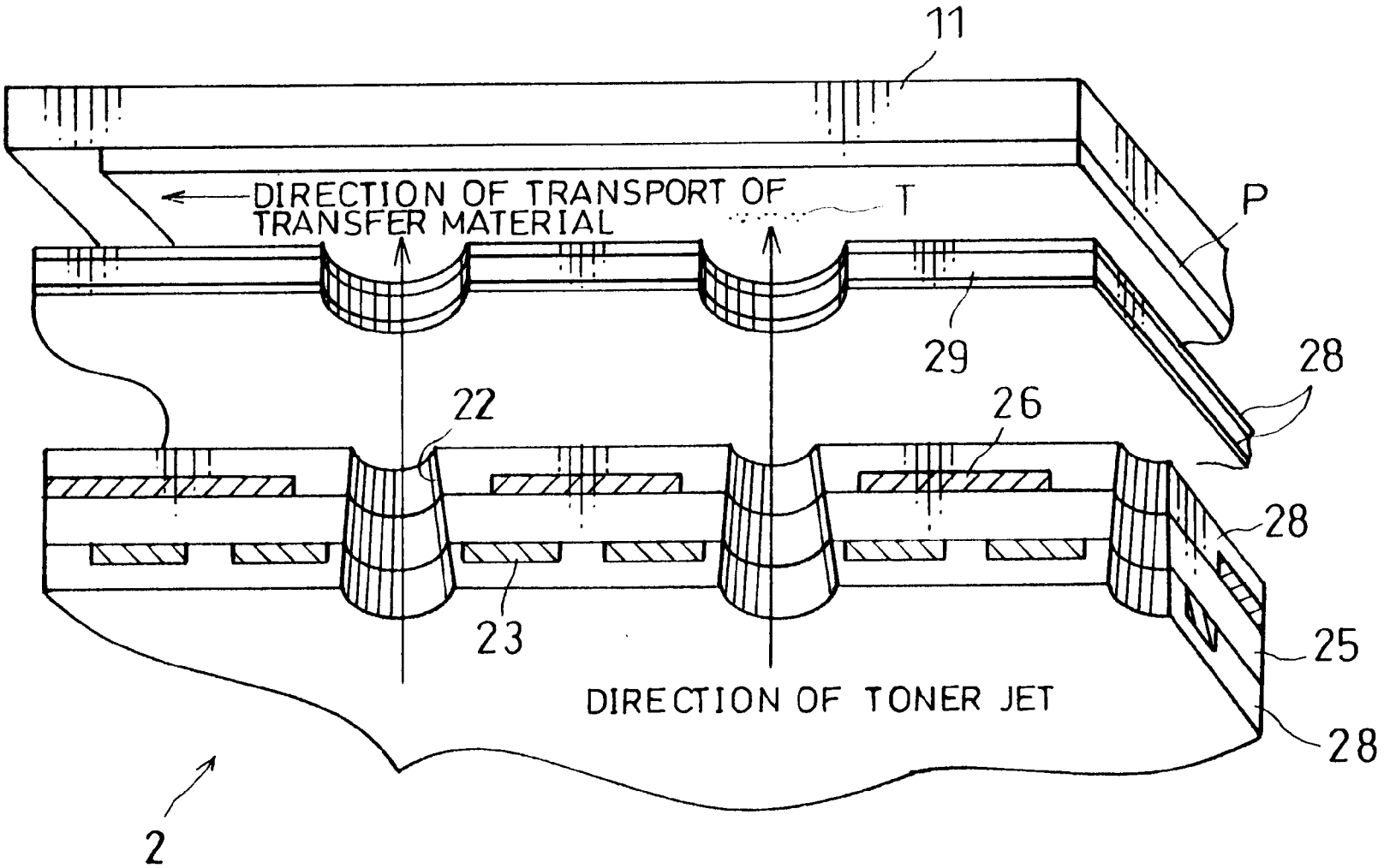
FIG. 15 is a perspective view showing a jet control section provided with a first electrode layer, provided in the foregoing image forming device.

In the present Example, as shown in FIGS. 14 through 16, a first electrode layer 29, through which the toner T can pass, was provided between the jet control section 2 and the counter electrode 11. Here, with E2 showing the intensity of an electrical field between the lens electrodes 26 of the jet control section 2 and the first electrode layer 29, and E1 the intensity of an electrical field between the first electrode layer 29 and the counter electrode 11, the potential difference VH and image quality of the toner image were as shown in Table 4 below.

TABLE 4

| | CONDITIONS | | | | |
|---|---|---|---|---|---|
| | 1 ON | 2 ON | 3 ON | 4 ON | 5 ON |
| COUNTER ELECTRODE POTENTIAL (V) | 1000 | 1500 | 1500 | 1500 | 2000 |
| CONTROL ELECTRODE POTENTIAL (V) | 350 | 350 | 350 | 350 | 350 |
| LENS ELECTRODE POTENTIAL (V) | 100 | 100 | 100 | 100 | 100 |
| TONER CARRIER POTENTIAL (V) | 20 | 20 | 20 | 20 | 20 |
| FIRST ELECTRODE LAYER POTENTIAL (V) | 500 | 1200 | 950 | 1200 | 1200 |
| LENS-FIRST ELECTRODE LAYER DISTANCE d2 (μm) | 200 | 700 | 400 | 300 | 700 |
| FIRST ELECTRODE LAYER-COUNTER ELECTRODE DISTANCE d1 (μm) | 200 | 100 | 300 | 500 | 250 |
| LENS-FIRST ELECTRODE LAYER POTENTIAL DIFFERENCE V2 (V) | 400 | 1100 | 850 | 1100 | 1100 |
| FIRST ELECTRODE LAYER-COUNTER ELECTRODE POTENTIAL DIFFERENCE V1 (V) | 500 | 300 | 550 | 300 | 800 |
| TONER CARRIER-COUNTER ELECTRODE POTENTIAL DIFFERENCE VH (V) | 980 | 1480 | 1480 | 1480 | 1980 |
| LENS-FIRST ELECTRODE LAYER ELECTRICAL FIELD INTENSITY E2 (kV/mm) | 2.00 | 1.57 | 2.13 | 3.67 | 1.57 |
| FIRST ELECTRODE LAYER-COUNTER ELECTRODE ELECTRICAL FIELD INTENSITY E1 (kV/mm) | 2.80 | 3.00 | 1.83 | 0.60 | 3.20 |
| IMAGE QUALITY | GOOD | GOOD | FAIR | POOR | POOR |

As shown in Table 4, satisfactory results were obtained under Conditions 1, 2, and 3, with results under Conditions 1 and 2 being most preferable.

Conditions 1, 2, and 3 satisfied VH≦1.5 kV and EH≧1.8 kV/mm, and at least fair image quality was obtained. Incidentally, E1 was too small under Conditions 4, and VH was too large under Conditions 5, and thus image quality was Poor in both cases.

Under Conditions 3, image quality was Fair, but it is preferable to set the conditions so as to satisfy E1>E2, VH≦1.5 kV, and E1≧1.8 kV/mm.

In the present Example, the inventors found that by providing the first electrode layer 29, through which the toner T can pass and to which a voltage can be applied, between the jet control section 2 (control means) and the counter electrode 11, and by setting a potential difference VH between the toner carrier 31 and the counter electrode 11, a potential difference V1 between the first electrode layer 29 and the counter electrode 11, a distance d1 between the first electrode layer 29 and the counter electrode 11, and an electrical field intensity E1 in the vicinity of the counter electrode 11 (=V1/d1) (which are factors which influence toner jet speed when striking the transfer material P) so as to satisfy VH≦1.5 kV and E1 (V1/d1)≧1.8 kV/mm, regardless of the distance of the jet control section 2 from the counter electrode 11, the electrical field intensity E1 could be optimized, and a converged toner image with little scattering could be formed.

Since the distance between the toner carrier 31 and the jet control section 2 is typically maintained at around 100 μm, for example, the jet control section 2 is usually integrally provided with the toner supply section 3, which includes the toner carrier 31. In such a case, rotation of the toner carrier 31 may cause vibration of the jet control section 2 in the direction of the toner jet. However, in the present Example, since the conditions of control of the toner T when it strikes the transfer material P are determined by the voltage applied to the first electrode layer 29 and the distance between the first electrode layer 29 and the counter electrode 11, a converged toner image with little scattering can be formed even if such vibration occurs.

Incidentally, instead of providing the first electrode layer 29 separately from the jet control section 2, it may be provided integrally therewith. Further, the first electrode layer 29 may be provided so as to come into contact with the transfer material P at a position upstream, with respect to the direction of movement of the transfer material P, from the position at which the toner T strikes the transfer material P. so that the counter electrode 11 and the transfer material P are a fixed distance from one another. In this way, it is possible to maintain a constant interval between the first electrode layer 29 and the transfer material P.

Example 5

In the present Example, the electrical field intensity E1 between the counter electrode 11 and the first electrode layer 29 was set to a larger value than the electrical field intensity E2 between the lens electrodes 26 and the first electrode layer 29.

This resulted in a marked reduction in scattering of the toner image on the transfer material P.

In this way, it is possible to set the electrical field intensity E2 between the lens electrodes 26 (control means) and the first electrode layer 29 and the electrical field intensity E1 between the first electrode layer 29 and the counter electrode 11 such that E1>E2, and in this way the speed of the toner jet when striking the transfer material P can be reduced, and the electrical field intensity in the vicinity of the counter electrode 11 increased, even when an interval between the lens electrodes 26 and the counter electrode 11 is large. Thus a converged toner image with little scattering can be formed.

Example 6

Figure 17A:
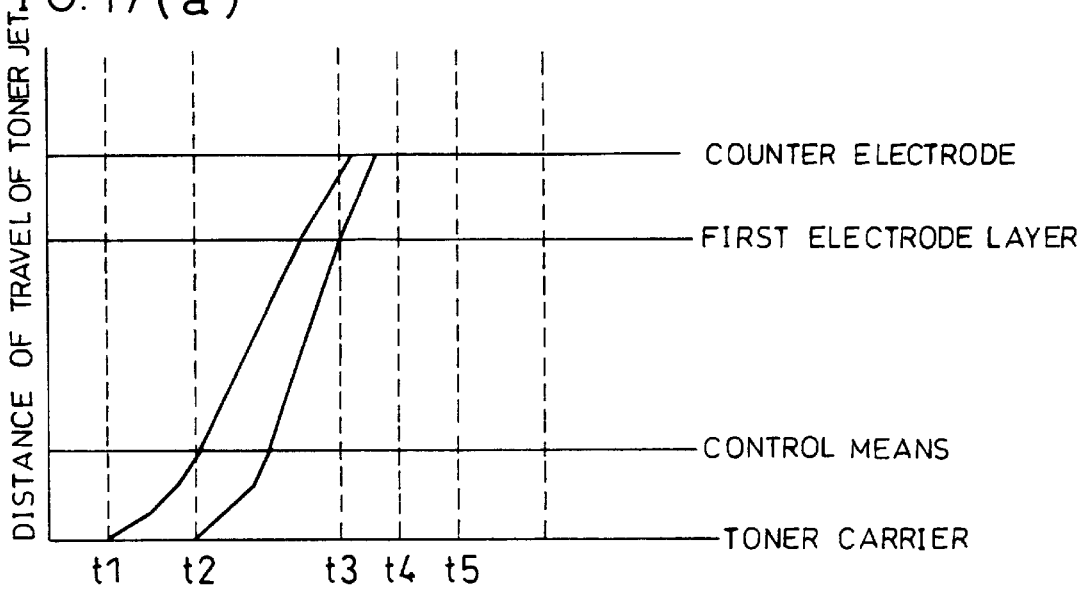
FIGS. 17(*a*) and 17(*b*) are timing charts showing control of voltage applied to the foregoing jet control section provided with a first electrode layer, provided in the foregoing image forming device, with FIG. 17(*a*) showing a relationship between distance of travel of a jet and duration of application of voltage, and FIG. 17(*b*) showing a relationship between applied voltage and duration of application.
Figure 17B:
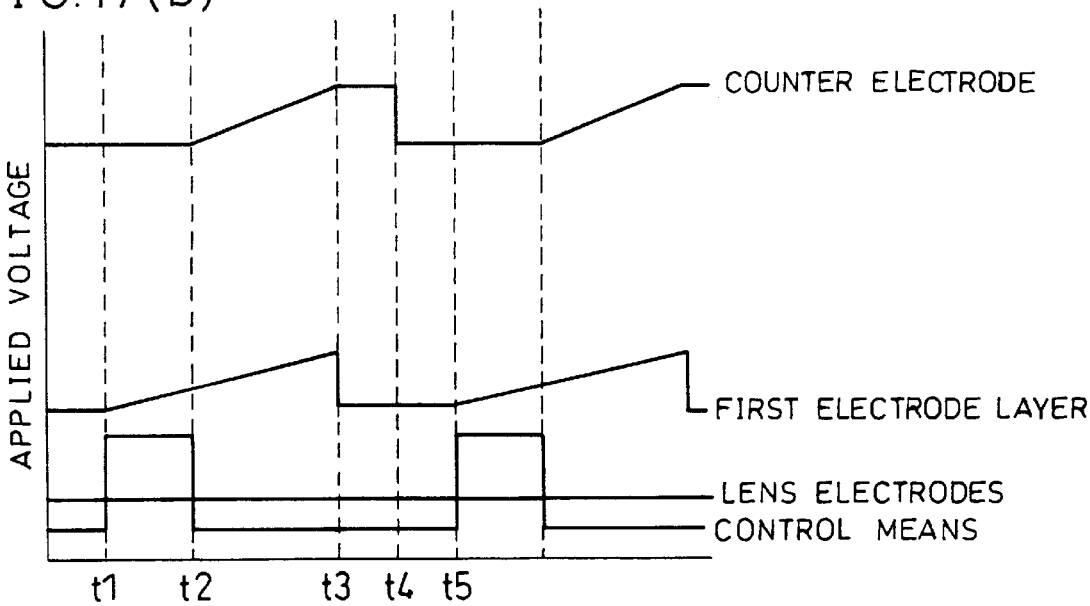

In the present Example, as shown in FIGS. 17(*a*) and 17(*b*), voltages applied to the first electrode layer 29 and the counter electrode 11 were gradually increased so that, from the beginning of a first voltage application period (from t1 to t2 in the Figures) to the end of a second voltage application period (from t2 to t5 in the Figures), the electrical field intensity E1 between the counter electrode 11 and the first electrode layer 29 and the electrical field intensity E2 between the lens electrodes 26 and the first electrode layer 29 gradually increased. Under these conditions, a converged toner image could be formed on the transfer material P.

In this way, it is possible to change the voltages applied to the first electrode layer 29 and the counter electrode 11 so that E1 and E2 gradually increase from the beginning of the first voltage application period to the end of the second voltage application period.

In this way, by, as shown in FIG. 17(*b*), gradually increasing the electrical field intensity E2 between the lens electrodes 26 (control means) of the jet control section 2 and the first electrode layer 29 and the electrical field intensity E1 between the first electrode layer 29 and the counter electrode 11 during the period from t1 to t5, speed of the toner, which begins jetting upon application of the first potential (from t1 to t2), increases with time. As a result, as shown in FIG. 17(*a*), a time interval between the arrival of the first toner T to reach the vicinity of the counter electrode 11 and the arrival of the last toner T to reach the vicinity of the counter electrode 11 is reduced, and as a result the toner image can be converged in the direction of transport of the transfer material P.

Example 7

In the present Example, as shown in FIGS. 17(*a*) and 17(*b*), beginning of change of a voltage applied to the first electrode layer 29 was set at t1, simultaneously with commencement of application of the first potential to the control electrodes 23 (control means), and beginning of change of a voltage applied to the counter electrode 11 was set at t2, i.e., later than the beginning of change of the voltage applied to the first electrode layer 29.

This resulted in reduction of scattering of the toner image on the transfer material P.

In this way, by changing the voltage applied to the first electrode layer 29 prior to changing the voltage applied to the counter electrode 11, voltage can be applied efficiently, in accordance with the position of the jet of toner T.

For example, if a jet electrical field takes effect at 2 kV/mm, and the control electrodes 23 (control means) are positioned at 150 μm from the toner carrier 31, the first electrode layer 29 at 800 μm from the toner carrier 31, and the counter electrode 11 at 1mm from the toner carrier 31, it takes at least 300 μsec for the first toner T leaving the toner carrier 31 to reach the first electrode layer 29. Incidentally, speed of the toner jet is determined by electrical field intensity, particle diameter of the toner T, and the quantity of charge the toner T is given, but since air resistance to the toner particles increases with increasing toner jet speed, in toner jet image forming devices like that of the present invention, the upper limit of toner jet speed is approximately a speed in accordance with the foregoing duration, i.e., at least 300 μsec. Accordingly, the change of the voltage applied to the counter electrode 11 may take place after change of the voltage applied to the first electrode layer 29, i.e., any time after 300 μsec, and by this means, power consumption can also be reduced.

Incidentally, the curve of toner transition with respect to time varies with specific charge of the toner particles, particle diameter, distance and potential difference between the respective electrodes, etc. FIG. 17(*a*) shows a general example of this transition.

Further, due to the effect of the increase in potential of the first electrode layer, toner particles leaving the toner carrier at time t2 are subject to a stronger electrical field than were those which left at time t1. For this reason, the duration required to move from the control electrodes to the first electrode layer is shorter for the toner particles which left the toner carrier at time t2 than for those which left at time t1.

In FIG. 17(*a*), the lens electrodes are located substantially at the control means; actually, slightly above the control means.

Further, at time t3, almost all of the toner particles are between the first electrode layer and the counter electrode, and begin to strike the transfer material positioned on the counter electrode. At this time, in the present Example, in order to prevent deflection of the path of the toner particles when striking the transfer material, a strong electrical field is formed in the vicinity of the counter electrode. In other words, here, the potential of the first electrode layer is reduced, so that a strong electrical field may be formed while still maintaining the potential of the counter electrode at a uniform potential to prevent bounce of the toner particles upon impact.

Example 8

In the present Example, as shown in FIG. 18, as the transfer material P, a transfer belt 54 (endless member) made of polyimide 50 μm in thickness was provided in contact with the counter electrode 11.

As a result, even when the distance between the counter electrode 11 and the first electrode layer 29 was 100 μm, the transfer belt 54 did not come into contact with the first electrode layer 29, and it was possible to form converged toner images with almost no scattering.

As discussed above, the present image forming device may be structured so that the transfer material P is an endless member, such as the transfer belt 54 made of polyimide 50 μm in thickness, provided in contact with the counter electrode 11.

By means of this structure, the control electrodes 23 (control means) and the counter electrode 11 may be provided as close as 100 μm to each other, and the potential of the counter electrode 11 can be reduced. For this reason, the capacity of the power source can be reduced, and leaks and shocks due to insulation breakdown can be prevented, thus improving safety.

Further, by reducing the distance of travel of the toner jet, the energy of collision of the toner T on impact is reduced, even when the jet electrical field is strong, and thus toner images with little scattering can be formed.

Incidentally, instead of the foregoing polyimide, a conductive material may be used as the endless transfer belt 54, such as stainless steel in the shape of a belt approximately 100 μm in thickness. Further, when a conductive material is used for the transfer belt 54, the transfer belt 54 may be used as the counter electrode 11, and a jet electrical field can be formed regardless of the thickness of the transfer belt 54. Moreover, charging of the transfer belt 54 due to friction, etc. can also be prevented. Further alternatives include a high-resistance transfer belt 54 made of polyimide kneaded with carbon, and a transfer belt 54 made of a polymer material such as polyester film.

Example 9

In the present Example, as shown in FIG. 18, suspension means were provided downstream, with respect to the rotation direction of the transfer belt 54, from the point where the transfer belt 54 touches the counter electrode 11, structured of a heat roller 62 containing a heater 61, and a pressure roller 63, by means of which the surface of the transfer belt 54 carrying the toner image was brought into contact with a recording material K.

As a result, the toner T on the transfer belt 54 was transferred to and fused on the recording material K, and good toner images could be formed on the recording material K.

In this way, by heating while bringing the toner image on the transfer belt 54 (the transfer material P) into contact with the recording material K, the toner T is transferred from the transfer belt 54 to the recording material K, making direct transfer possible, without providing further transfer means. Thus the device can be reduced in size. Further, since the toner particles are fused at the time of transfer to the recording material K, toner scattering during transfer can be prevented, and the converged image with little scattering formed on the transfer belt 54 can be transferred to the recording material K without loss of print quality.

Example 10

In the present Example, as shown in FIG. 18, suspension means were provided upstream, with respect to the rotation direction of the transfer belt 54, from the point where the transfer belt 54 touches the counter electrode 11, structured of a tension pulley 55, so that the transfer belt 54 was held between the tension pulley 55 and an adhesive applying member 81 which rubs against the transfer belt 54 made of a porous, flexible material. The adhesive applying member 81 contained silicone oil, which was coated onto the transfer belt 54 by friction between the adhesive applying member 81 and the transfer belt 54.

As a result, the silicone oil coated onto the transfer belt 54 further reduced the scattering of the toner T on impact, and good printing could be continued even when printing for a long time.

In this way, by providing, upstream, with respect to the rotation direction of the transfer belt 54, from a point opposite the control electrodes 23, the adhesive applying member 81 (coating means), which coats an adhesive onto the toner transfer surface of the transfer belt 54, scattering of the toner T striking the transfer belt 54 can be further reduced.

Further, scattering of the toner T on the transfer belt 54 while traveling from the point opposite the control electrodes 23, at which the toner T strikes the transfer belt 54, to the point of transfer to the recording material K, can also be reduced.

Incidentally, in the present Example, use of silicone oil as the adhesive had the additional effect of improving mold release from the heat roller 62 and the pressure roller 63 during transfer and fixing. However, there is no particular limitation to silicone oil, and short-term affixing of the toner T to the transfer belt 54 after impact thereon may alternatively be accomplished by coating onto the transfer belt 54 a viscous agent made of a viscous substance dissolved in a volatile solvent.

Further, the present Example explained a case in which silicone oil is coated onto the transfer belt 54, but there is no particular limitation to this. Alternatively, silicone oil may be coated onto the transfer material P, i.e., onto paper.

As discussed above, an image forming device according to the present invention comprises a toner carrier, which carries toner charged with a predetermined polarity; a counter electrode, provided opposite the toner carrier, to which a voltage can be applied; control means, provided between the toner carrier and the counter electrode, having a plurality of gates, each forming a space for passage of a jet of toner from the toner carrier toward the counter electrode; and voltage applying means, capable of applying potentials which are independent of each other to each of the gates of the control means; the image forming device controlling passage of toner through a given gate by application of a first potential which allows passage of the toner through that gate and a second potential which prevents passage of the toner through that gate, and forming a toner image on a transfer material, which is in contact with the counter electrode and which moves relative to the control means; in which a potential difference VH between the toner carrier and the counter electrode and an intensity EH of an electrical field in the vicinity of the counter electrode satisfy $VH \leqq 1.5$ kV and $EH \geqq 1.8$ kV/mm, respectively.

With the foregoing structure, by optimizing a potential difference between the toner carrier and the counter electrode and an electrical field intensity in the vicinity of the counter electrode, i.e., on the surface of the transfer material, it is possible to form good toner images with little scattering.

Figure 19:
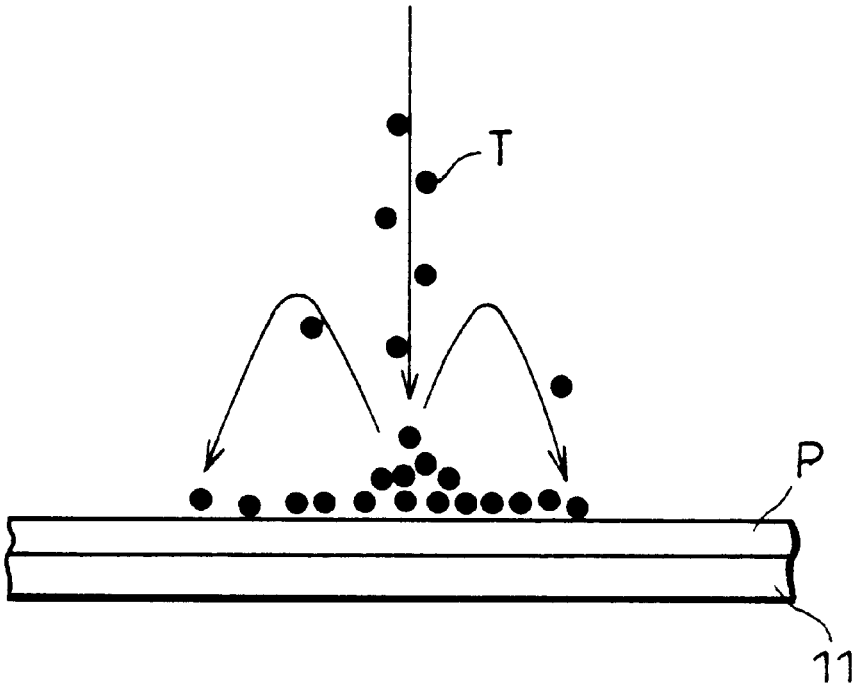
FIGS. 19(*a*) and 19(*b*) are explanatory drawings showing toner particles striking a transfer material P in a conventional image forming device, with FIG. 19(*a*) showing the case of a jet of high speed, which increases repulsive force when the toner particles strike the transfer material P, causing the toner particles to rebound and increasing scattering to areas surrounding the pixel.
Figure 19:
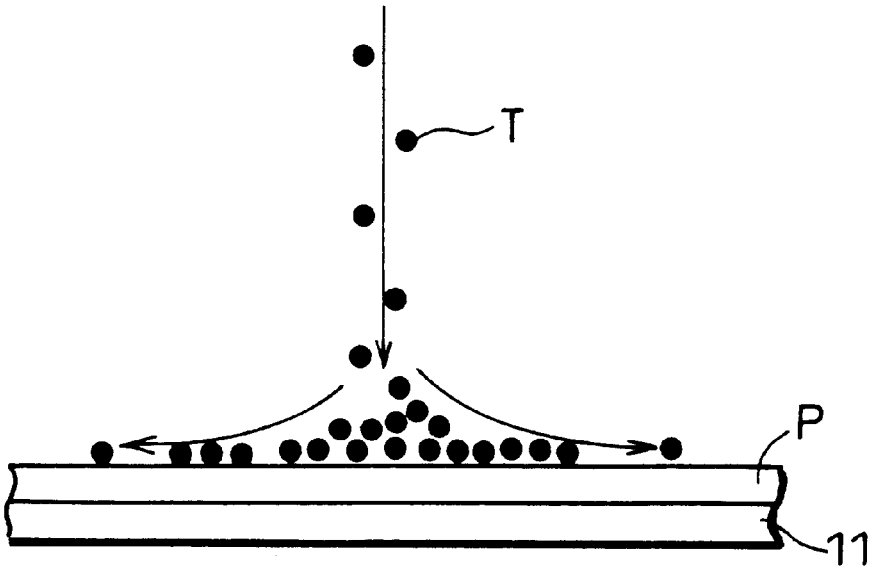

In other words, as shown in FIGS. 19(*a*) and 19(*b*), toner particles T leave the toner carrier, pass through the gates of the control means, and jet toward the counter electrode 11.

At this time, if the speed of the jet is high, repulsive force when the toner particles T strike the transfer material P is increased, and the toner particles T rebound greatly, as shown in FIG. 19(*a*), thus increasing scattering to areas surrounding the pixel.

If, on the other hand, electrical field intensity in the vicinity of the transfer material P is weak, the influence of repulsive force among the toner particles T, charging of the transfer material P, etc. causes the toner particles T to spread out over the surface of the transfer material P immediately before and after impact, as shown in FIG. 19(*b*).

Increasing the electrical field intensity and the distance the jet travels increases the speed of the toner jet, and thus increases rebound of the toner particles. However, decreasing the intensity of the jet electrical field increases the mutual repulsive force among the toner particles while in the jet and upon striking the transfer material, and also decreases the force with which they are attracted toward the counter electrode 11, thus causing spreading of the toner image.

Investigations conducted to resolve the foregoing problems revealed that a converged toner image with little scattering can be formed if a potential difference VH between the toner carrier and the counter electrode 11 and an intensity EH of an electrical field in the vicinity of the counter electrode 11, which influence the speed of the toner jet when striking the transfer material, are set to $VH \leqq 1.5$ kV and $EH \geqq 1.8$ kV/mm, respectively.

In other words, by optimizing a potential difference between the toner carrier and the counter electrode and an electrical field intensity in the vicinity of the counter electrode, i.e., on the surface of the transfer material, it is possible to form good toner images with little scattering.

Incidentally, if the control means are made up of a single layer of control electrodes only, the potential difference between the control electrodes and the counter electrode 11 and the electric field intensity in the vicinity of the counter electrode 11 vary according to the ON potential (first potential) and OFF potential (second potential) of the control electrodes, but if the foregoing conditions are satisfied, a converged toner image free of scattering can be obtained.

Further, in the foregoing image forming device, it is preferable if the control means include a plurality of electrode layers extending two-dimensionally opposite the toner carrier, with the plurality of gates penetrating the plurality of electrode layers, and if the voltage applying means apply potentials which are independent of each other to each of the gates by applying different potentials to the respective electrodes of each of the adjacent electrode layers, in order to apply voltages selectively in accordance with image signals.

With the foregoing structure, the control means can be structured of two electrode layers, with the gates penetrating both layers, in which a given gate allows passage of toner only when electrodes of both layers corresponding to that gate are ON.

With this kind of arrangement, since the total number of pixels is determined by the product of the number of electrodes in the electrode layers, the number of costly driver elements, for switching voltages applied to the electrodes of the respective electrode layers, can be greatly reduced.

In addition, with this kind of arrangement, since factors which influence the impact of toner on the transfer material, such as electrical field intensity and the potential difference between the control means and the counter electrode are determined solely by the electrode layer of the control means closest to the counter electrode, the same effects as above can be obtained, and a converged toner image with little scattering can be formed.

Further, in the foregoing image forming device, it is preferable if the control means include a plurality of electrodes provided in a plurality of electrode layers extending two-dimensionally opposite the toner carrier, with the plurality of gates penetrating the plurality of electrode layers, and if the voltage applying means apply a constant voltage to an electrode layer, such as a layer of lens electrodes, provided on a side of the control means facing the counter electrode.

With the foregoing structure, by providing the side of the control means facing the counter electrode with a layer of electrodes, such as lens electrodes, to which a constant voltage can be applied, the electrical field intensity near the counter electrode and a potential difference between the lens electrodes and the counter electrode can be optimized, regardless of the voltage applied to the control electrodes, and thus converged toner images with little scattering can be formed, regardless of the voltage applied to the control electrodes and the duration of voltage application.

Incidentally, when the lens electrodes are provided so as to be exposed on the side of the control means facing the counter electrode, it is possible to prevent charging of the surface of the control means when a paper jam, etc. causes the transfer material to come into contact with the control means.

Another image forming device according to the present invention comprises a toner carrier, which carries toner charged with a predetermined polarity; a counter electrode, provided opposite the toner carrier, to which a voltage can be applied; control means, provided between the toner carrier and the counter electrode, having a plurality of gates, each forming a space for passage of a jet of toner from the toner carrier toward the counter electrode; and voltage applying means, capable of applying potentials which are independent of each other to each gate of the control means; with the image forming device controlling passage of toner through a given gate by application of a first potential which allows passage of the toner through that gate and a second potential which prevents passage of the toner through that gate, and forming a toner image on a transfer material, which is in contact with the counter electrode and which moves relative to the control means; in which the image forming device further comprises, between the control means and the counter electrode, a first electrode layer extending two-dimensionally opposite the counter electrode, provided with holes, corresponding to the gates of the control means, for passage of toner; and a potential difference VH between the toner carrier and the counter electrode, a potential difference V1 between the first electrode layer and the counter electrode, a distance d1 between the first electrode layer and the counter electrode, and an intensity E1 (=V1/d1) of an electrical field in the vicinity of said counter electrode satisfy VH≦1.5 kV and E1≧1.8 kV/mm, respectively.

In other words, the present inventors found that by providing the first electrode layer, through which toner can pass and to which a voltage can be applied, between the control means and the counter electrode, and by setting a potential difference VH between the toner carrier and the counter electrode, a potential difference V1 between the first electrode layer and the counter electrode, a distance d1 between the first electrode layer and the counter electrode, and an electrical field intensity E1 in the vicinity of the counter electrode (=V1/d1) (which are factors which influence toner jet speed when striking the transfer material) so as to satisfy VH≦1.5 kV and E1≧1.8 kV/mm, regardless of the distance of the control means from the counter electrode, the electrical field intensity E1 could be optimized, and a converged toner image with little scattering could be formed.

For example, since the distance between the toner carrier and the control means is typically maintained at around 100 μm, for example, the control means are usually integrally provided with a toner supply section, which includes the toner carrier. In such a case, rotation of the toner carrier may cause vibration of the control means in the direction of the toner jet. However, in the present invention, since the conditions of control of the toner when it strikes the transfer material are determined by the voltage applied to the first electrode layer and the distance between the first electrode layer and the counter electrode, a con verged toner image with little scattering can be formed even if such vibration occurs.

Incidentally, instead of providing the first electrode layer separately from the control means, it may be provided integrally therewith.

Further, the first electrode layer may be provided so as to come into contact with the transfer material at a position upstream, with respect to the direction of movement of the transfer material, from a position at which the toner strikes the transfer material, so that the first electrode is a fixed distance from the counter electrode and the transfer material. In this way, it is possible to maintain a constant interval between the first electrode layer and the transfer material.

Further, in the foregoing image forming device, when E2 is an intensity of an electrical field between the control means and the first electrode layer, and E1 is an intensity of an electrical field between the first electrode layer and the counter electrode, it is preferable if E1 and E2 satisfy E1>E2.

With the foregoing structure, by setting the electrical field intensity E1 between the first electrode layer and the counter electrode to a value greater than the electrical field intensity E2 between the control means and the first electrode layer, the speed of the toner jet when striking the transfer material can be reduced, and the electrical field intensity in the vicinity of the counter electrode increased, even when an interval between the control means and the counter electrode is large. Thus a converged toner image with little scattering can be formed.

Further, in the foregoing image forming device, it is preferable if voltages applied to the first electrode layer and to the counter electrode are changed such that, during a period from commencement of application of the first potential to the control means through conclusion of application of the second potential to the control means, E1 and E2 gradually increase.

With the foregoing structure, the voltages applied to the first electrode layer and to the counter electrode are changed so that, beginning with commencement of application of the first potential (the ON potential) to the control means, the electrical field intensity between the first electrode layer and the counter electrode (E1) and the electrical field intensity between the control means and the first electrode layer are gradually increased.

By this means, the speed of the jetting toner increases over time. As a result, a time interval between arrival of the first toner to reach the vicinity of the counter electrode and the arrival of the last toner to reach the vicinity of the counter electrode can be shortened, and thus the toner image is converged in the transport direction of the transfer material.

Further, in the foregoing image forming device, it is preferable if the voltage applied to the first electrode layer is changed prior to changing the voltage applied to the counter electrode.

With the foregoing structure, since the change of the voltage applied to the first electrode layer takes place before the change of the voltage applied to the counter electrode, voltage can be applied efficiently, in accordance with the position of the toner jet.

Further, in the foregoing image forming device, it is preferable if an endless member is used as the transfer material.

In this case, the transfer material can be structured as an endless member such as a transfer belt made of, for example, polyimide 50 μm in thickness, provided in contact with the counter electrode.

By means of this structure, the control means and the counter electrode may be provided as close as 100 μm to each other, and the potential of the counter electrode can be reduced. For this reason, the capacity of the power source can be reduced, and leaks and shocks due to insulation breakdown can be prevented, thus improving safety.

In addition, by reducing the distance of travel of the toner jet, the energy of collision of the toner on impact is reduced, even when the jet electrical field is strong, and thus toner images with little scattering can be formed.

Further, in the foregoing image forming device, it is preferable to provide coating means upstream, with respect to the direction of transport of the transfer material, from a point of the transfer material opposite the control means, for coating an adhesive material onto the transfer material.

With the foregoing structure, since coating means, for coating an adhesive material onto the transfer material, are provided upstream, with respect to the direction of transport of the transfer material, from a point of the transfer material opposite the control means, scattering of the toner when striking the transfer material can be further reduced.

In addition, scattering of the toner during movement of the transfer material can also be prevented.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations, provided such variations do not depart from the spirit of the present invention or exceed the scope of the patent claims set forth below.

What is claimed is:

1. An image forming device comprising:

a toner carrier, which carries toner charged with a predetermined polarity;

a counter electrode, provided opposite said toner carrier, to which a voltage can be applied;

control means, provided between said toner carrier and said counter electrode, having a plurality of gates, each forming a space for passage of a jet of toner from said toner carrier toward said counter electrode, and at least one electrode layer for controlling the jet of the toner, said control means controlling passage of toner through a given gate by application of a first potential which allows passage of the toner through said gate or a second potential which prevents passage of the toner through said gate, in order to form a toner image on a transfer material, said transfer material being both in contact with said counter electrode and movable relative to said control means; and voltage applying means for applying potentials which are independent of each other to each said gate of said control means, said voltage applying means applying voltages to said toner carrier, to said counter electrode, and to said at least one electrode layer, such that a potential difference VH between said toner carrier and said counter electrode and an intensity EH of an electrical field between said counter electrode and the one of said at least one electrode layer closest to the counter electrode satisfy $VH \leqq 1.5$ kV and $EH \geqq 1.8$ kV/mm, respectively.

2. The image forming device set forth in claim 1, wherein:

said control means include a plurality of electrode layers extending two-dimensionally opposite said toner carrier, said plurality of gates penetrating said plurality of electrode layers; and said voltage applying means apply potentials which are independent of each other to each of said gates by applying different potentials to the respective electrodes of each of said adjacent electrode layers, in order to apply voltages selectively in accordance with image signals.

3. The image forming device set forth in claim 1, wherein:

said control means include a plurality of electrodes provided in a plurality of electrode layers extending two-dimensionally opposite said toner carrier, and a plurality of gates penetrating said plurality of electrode layers; and said voltage applying means apply a fixed voltage to an electrode layer provided on a side of said control means facing said counter electrode.

4. The image forming device set forth in claim 1, wherein:

an endless member is used as said transfer material.

5. The image forming device set forth in claim 1, further comprising:

coating means, provided upstream, with respect to a direction of transport of said transfer material, from a point of said transfer material opposite said control means, for coating an adhesive material onto said transfer material.

6. An image forming device comprising:

a toner carrier, which carries toner charged with a predetermined polarity;

a counter electrode, provided opposite said toner carrier, to which a voltage can be applied;

control means, provided between said toner carrier and said counter electrode, having a plurality of gates, each forming a space for passage of a jet of toner from said toner carrier toward said counter electrode, said control means controlling passage of toner through a given gate by application of a first potential which allows passage of the toner through said gate or a second potential which prevents passage of the toner through said gate, so as to form a toner image on a transfer material, said transfer material being both in contact with said counter electrode and movable relative to said control means;

a first electrode layer extending two-dimensionally opposite said counter electrode, provided with holes, corresponding to said gates of said control means, for passage of toner; and voltage applying means for applying potentials which are independent of each other to each said gate of said control means, said voltage applying means applying voltages to said toner carrier, to said counter electrode, and to said first electrode layer, such that a potential difference VH between said toner carrier and said counter electrode, a potential difference V1 between said first electrode layer and said counter electrode, a distance d1 between said first electrode layer and said counter electrode, and an intensity E1 (=V1/d1) of an electrical field between said counter electrode and said first electrode layer satisfy $VH \leqq 1.5$ kV and $E1 \geqq 1.8$ kV/mm, respectively.

7. The image forming device set forth in claim 6, wherein:

when E2 is an intensity of an electrical field between said control means and said first electrode layer, and E1 is an intensity of an electrical field between said first electrode layer and said counter electrode, said voltage applying means apply voltages such that E1 and E2 satisfy $E1 > E2$.

8. The image forming device set forth in claim 7, wherein:

said voltage applying means change voltages applied to said first electrode layer and to said counter electrode, such that, during a period from commencement of application of the first potential to said control means through conclusion of application of the second potential to said control means, E1 and E2 gradually increase.

9. The image forming device set forth in claim 8, wherein:

the voltage applied to said first electrode layer is changed prior to changing the voltage applied to said counter electrode.

10. The image forming device set forth in claim 6, wherein:

an endless member is used as said transfer material.

11. The image forming device set forth in claim 6, further comprising:

coating means, provided upstream, with respect to a direction of transport of said transfer material, from a point of said transfer material opposite said control means, for coating an adhesive material onto said transfer material.

12. An image forming device comprising:

a toner carrier, which carries toner charged with a predetermined polarity;

a counter electrode, provided opposite said toner carrier, to which a voltage can be applied;

a control electrode layer including a plurality of control electrodes, provided between said toner carrier and said counter electrode, having a plurality of gates, each forming a space for passage of a jet of toner from said toner carrier toward said counter electrode, said control electrode layer controlling passage of toner through a given gate by application of a first potential which allows passage of the toner through said gate or a second potential which prevents passage of the toner through said gate, so as to form a toner image on a transfer material, said transfer material being both in contact with said counter electrode and movable relative to said control electrode layer;

at least one auxiliary control electrode layer extending two-dimensionally between said control electrode layer and said counter electrode, and opposite said counter electrode, said at least one auxiliary control electrode layer being provided with holes, corresponding to said gates of said control electrode layer, for passage of toner; and voltage applying means for applying the first potential or the second potential, which are independent of each other, to each said gate of said control electrode layer, and applying a predetermined voltage to each of said toner carrier and said counter electrode, and an intermediate voltage between the voltage applied to said toner carrier and the voltage applied to said counter electrode, entirely over said at least one auxiliary control electrode layer, wherein said voltage applying means applies voltages to said toner carrier, to said counter electrode, and to said auxiliary control electrode layer, such that a potential difference VH between said toner carrier and said counter electrode, and an intensity E1 of an electrical field between the one of said at least one auxiliary control electrode layer closest to said counter electrode and said counter electrode satisfy $VH \leqq 1.5$ kV and $E1 \geqq 1.8$ kV/mm, respectively.

* * * * *